US007895826B2

(12) United States Patent
Takubo

(10) Patent No.: US 7,895,826 B2
(45) Date of Patent: Mar. 1, 2011

(54) AIR FUEL RATIO CONTROL APPARATUS FOR AN INTERNAL COMBUSTION ENGINE

(75) Inventor: Hideki Takubo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 701 days.

(21) Appl. No.: 11/965,055

(22) Filed: Dec. 27, 2007

(65) Prior Publication Data

US 2008/0295488 A1 Dec. 4, 2008

(30) Foreign Application Priority Data

Jun. 4, 2007 (JP) ..... 2007-148233

(51) Int. Cl.
*F01N 3/00* (2006.01)

(52) U.S. Cl. ..... 60/285; 60/274; 60/276

(58) Field of Classification Search ..... 60/285
See application file for complete search history.

(56) References Cited

U.S. PATENT DOCUMENTS

| | | | | |
|---|---|---|---|---|
| 5,115,639 | A * | 5/1992 | Gopp | 60/274 |
| 5,440,877 | A * | 8/1995 | Kamura et al. | 60/274 |
| 6,530,214 | B2 * | 3/2003 | Ikemoto et al. | 60/285 |
| 6,904,751 | B2 * | 6/2005 | Makki et al. | 60/285 |

FOREIGN PATENT DOCUMENTS

| | | | |
|---|---|---|---|
| JP | 63-208639 | A | 8/1988 |
| JP | 63195351 | A | 8/1988 |
| JP | 06042387 | A | 2/1994 |
| JP | 10-026043 | A | 1/1998 |
| JP | 2002-227689 | A | 8/2002 |

OTHER PUBLICATIONS

German Office Action dated, Sep. 10, 2009, corresponding to 10 2008 005 873.4-26.

* cited by examiner

*Primary Examiner*—Thomas E Denion
*Assistant Examiner*—Jason Shanske
(74) *Attorney, Agent, or Firm*—Sughrue Mion, PLLC

(57) ABSTRACT

An air fuel ratio control apparatus for an internal combustion engine can achieve control behavior with good stability and response that is appropriate for a delay in an oxygen storage operation of a catalyst, and can always keep the state of purification of the catalyst adequately. The apparatus includes an upstream oxygen sensor (13), a downstream oxygen sensor (15), a first air fuel ratio feedback control section (130) that adjusts an amount of fuel to be supplied so as to make an air fuel ratio in an upstream exhaust gas and an upstream target air fuel ratio (AFobj) coincide with each other, and a second air fuel ratio feedback control section (150) that operates the upstream target air fuel ratio (AFobj) in accordance with an air fuel ratio deviation between an air fuel ratio detected by the downstream oxygen sensor (15) and a downstream target air fuel ratio so as to make the detected air fuel ratio of said downstream oxygen sensor (15) and the downstream target air fuel ratio coincide with each other. The second air fuel ratio feedback control section (150) sets an integral gain of integral calculation to be larger in accordance with an increasing flow rate of the exhaust gas, and also sets a proportional gain of proportional calculation so as not to be changed with respect to a change in the flow rate of the exhaust gas.

4 Claims, 20 Drawing Sheets

AIR FUEL RATIO CONTROL APPARATUS FOR AN INTERNAL COMBUSTION ENGINE

BACKGROUND OF THE INVENTION

1. Field of the Invention

The present invention relates to an air fuel ratio control apparatus for an internal combustion engine.

2. Description of the Related Art

In general, a catalytic converter (hereinafter referred to simply as a "catalyst") with a three-way catalyst received therein for purifying harmful components HC, CO, NOx in an exhaust gas at the same time is installed in an exhaust passage of an internal combustion engine. Since such a kind of catalyst has a high purification rate for any of HC, CO and NOx in the vicinity of a stoichiometric air fuel ratio, an oxygen sensor is generally arranged at an upstream side of the catalyst so that an air fuel ratio of an air fuel mixture is controlled so as to make the air fuel ratio upstream of the catalyst become in the vicinity of the stoichiometric air fuel ratio.

In addition, the upstream oxygen sensor at the upstream side of the catalyst is arranged at a location of an exhaust system as close to combustion chambers as possible (i.e., a merged or collected portion of an exhaust manifold located upstream of the catalyst), and it is subjected to high exhaust temperatures and a variety of kinds of toxic substances, so the output characteristic of the oxygen sensor is caused to vary to a great extent.

Accordingly, a duel oxygen sensor system has been proposed in which in order to compensate for the characteristic variation of the upstream oxygen sensor, a downstream oxygen sensor is arranged at a location downstream of the catalyst, so that second air fuel ratio feedback control according to the downstream oxygen sensor is performed in addition to first air fuel ratio feedback control according to the upstream oxygen sensor (see, for example, a first patent document: Japanese patent application laid-open No. S63-1 95351 and a second patent document: Japanese patent application laid-open No. H6-42387).

The downstream oxygen sensor is low in response speed in comparison with the upstream oxygen sensor but has the following merits. That is, at the downstream side of the catalyst, the temperature of the exhaust gas is low, and hence the influence of heat is small, and in addition, various toxic substances are trapped by the catalyst, so the poisoning of the oxygen sensor is small, and the variation of the output characteristic of the oxygen sensor is small. Further, at the downstream side of the catalyst, the exhaust gas is mixed to a satisfactory extent, so the state of purification of the catalyst located at an upstream side can be detected in a stable manner.

Thus, in the duel oxygen sensor system, by correcting the upstream air fuel ratio and maintaining the output value of the downstream oxygen sensor to a target value, the variation of the output characteristic of the upstream oxygen sensor is compensated for, and the state of purification of the catalyst is adequately maintained.

In addition, for the purpose of absorbing a temporary variation of the upstream air fuel ratio from the stoichiometric air fuel ratio, the oxygen storage capability is added to the catalyst, whereby the catalyst takes in and accumulates oxygen in the exhaust gas when the air fuel ratio thereof is leaner than the stoichiometric air fuel ratio, whereas the catalyst releases the oxygen accumulated therein when the air fuel ratio is richer than the stoichiometric air fuel ratio.

In this manner, the catalyst has an annealing operation (or delayed averaging operation), and hence the variation of the air fuel ratio at the upstream side of the catalyst is processed in the catalyst in a delayed manner to provide an air fuel ratio at the downstream side of the catalyst. In addition, an upper limit value of the amount of oxygen storage is decided by the amount of a material with an oxygen storage capability which is added upon production of the catalyst.

Accordingly, when the amount of oxygen storage is saturated to the upper limit value or lower limit value (=0), the delay operation to absorb the variation of the upstream air fuel ratio no longer exists, so the air fuel ratio in the catalyst comes off from the stoichiometric air fuel ratio, and the purification ability of the catalyst reduces. At this time, the air fuel ratio downstream of the catalyst deviates greatly from the stoichiometric air fuel ratio, so it is possible to detect that the amount of oxygen storage in the catalyst has reached the upper limit value or lower limit value (=0).

When the amount of oxygen storage of the catalyst becomes a value between the upper limit value and the lower limit value, generating a delay operation of the catalyst, the purification rate of any of HC, CO and NOx in the exhaust gas becomes high, and in particular, the purification rate becomes the highest when the amount of oxygen storage of the catalyst is in an intermediate level between the upper limit value and the lower limit value. In addition, the amount of oxygen storage of the catalyst can be detected due to a minute change in the vicinity of the stoichiometric air fuel ratio of the downstream air fuel ratio. As a result, by controlling the output value of the downstream oxygen sensor to a target value, it is possible to control the amount of oxygen storage to an appropriate amount thereby to maintain the purification rate of the catalyst high.

Thus, to keep exhaust gas purification performance in an adequate manner, the stability of the feedback control using the downstream oxygen sensor (having a delay operation for the catalyst to be controlled) is important.

In addition, in a so-called PID feedback control using proportional calculation, integral calculation and differential calculation, the stability and response of the feedback control change in accordance with the magnitudes of a proportional gain Kp, an integral gain Ki and a differential gain Kd. That is, if the individual gains are set to be small, the stability is improved but the response is deteriorated. On the contrary, if the individual gains are set to be great, the stability is deteriorated but the response is improved.

A control quantity for the PID feedback control is represented, as shown by the following expression (1), by using a deviation err(t) between an actual value and a target value and the individual gains Kp, Ki and Kd.

$$\text{control quantity}=Kp\times err(t)+Ki\times\int_0^t err(t)dt+Kd\times derr(t)/dt \quad (1)$$

In a control object having a saturation state for the upper limit amount or the lower limit amount in which there exists no response delay, as in the oxygen storage operation of the catalyst, the stability of a control system decreases in accordance with the increasing set value for the proportional gain Kp, and finally it reaches a state in which a sustained oscillation continues. Here, note that even if the proportional gain Kp is set to be further greater, the control system becomes stable in the state of the sustained oscillation, and hence there is no change in the stability of the control system.

FIG. 19 is a timing chart illustrating the change over time of an output value of a general downstream oxygen sensor, wherein the waveforms of mutually different proportional gains Kp are shown respectively.

As shown in FIG. 19, the proportional gain Kp, the integral gain Ki and the differential gain Kd, which can provide good control performance, are set with a proportional gain Kpc and a sustained oscillation period Tc, at the time when the set value of the proportional gain Kp is gradually increased, being made as references. Such a gain setting method is called a limit sensitivity method in which a setting rule is applied as shown in the following expressions (2).

$$Kp=A\times Kpc$$

$$Ki=B\times Kpc/Tc$$

$$Kd=C\times Kpc\times Tc \quad (2)$$

In the above expressions (2), individual constants A, B, C are values that are adjusted in accordance with the kinds of delays of the object to be controlled such as, for example, a dead time delay, a primary delay, a secondary delay, etc, or in accordance with the design of a transient response.

In the feedback control using the downstream oxygen sensor, a delay in the oxygen storage operation of the catalyst is very large and predominant in comparison with other delays, and the limit of stability depends on the oxygen storage operation. This is because the delay in the oxygen storage operation of the catalyst is designed to be sufficiently great so as to absorb the variation of the air fuel ratio due to other delays such as a delay of the oxygen sensor, a delay in movement of the exhaust gas, etc.

In addition, the change rate of the amount of oxygen storage of the catalyst is proportional to the amount of change of the air fuel ratio at the upstream side of the catalyst from the stoichiometric air fuel ratio and the flow rate of exhaust gas qa.

FIG. 20 through FIG. 22 are timing charts illustrating the output value of the downstream oxygen sensor, an upstream target air fuel ratio, and the change over time of the amount of oxygen storage of the catalyst in association with one another, wherein FIG. 20 shows a case when the flow rate of exhaust gas qa is in a small level, FIG. 21 shows a case when the flow rate of exhaust gas qa is in an intermediate level, and FIG. 22 shows a case when the flow rate of exhaust gas qa is in a large level.

Also, in FIG. 20 through FIG. 22, the behaviors of the stability limit (sustained oscillation period Tc) are illustrated when the flow rate of exhaust gas qa changes from the small level to the large level through the intermediate level (i.e., small→intermediate→large). The amount of change of the air fuel ratio at the upstream side of the catalyst is decided in accordance with the magnitude of the proportional gain, so the proportional gain Kpc of the stability limit is not caused to change by the flow rate of exhaust gas qa. On the other hand, the change rate of the amount of oxygen storage is proportional to the flow rate of exhaust gas qa, so the sustained oscillation period Tc decreases in accordance with the increasing flow rate of exhaust gas qa, and the following expressions (3) hold.

$$Kpc=\text{constant}$$

$$Tc\propto 1/qa \quad (3)$$

Accordingly, complying with the setting rule of the limit sensitivity method according to the above-mentioned expressions (2), an optimal PID gain becomes as shown by the following expressions (4).

$$Kp=\text{definite value}$$

$$Ki\propto qa$$

$$Kd\propto 1/qa \quad (4)$$

In addition, in the past, there has been known a method of changing the control gain of feedback control using a downstream oxygen sensor in accordance with the flow rate of an exhaust gas (see, for example, a third patent document: Japanese patent application laid-open No. S63-208639, a fourth patent document: Japanese patent application laid-open No. H10-26043, and a fifth patent document: Japanese patent application laid-open No. 2002-227689).

In the third and fourth patent documents, the integral gain (the amount of update) of integral calculation is set so as to proportional to the flow rate of the, exhaust gas, so it is possible to achieve a highly stable control behavior that suits the delay of the oxygen storage operation of the catalyst.

Also, in the fifth patent document, it is designed such that the proportional gain and the integral gain are set in accordance with the exhaust gas flow rate.

In the conventional air fuel ratio control apparatuses for an internal combustion engine, for example in case of the third and fourth patent documents, feedback control is constituted only by integral calculation, so the response of the feedback control is poor in comparison with the case in which integral calculation and proportional calculation are used, thus giving rise to a problem that it is difficult to converge the state of purification of the catalyst deteriorated by external disturbances, etc., into a target value in a swift manner.

In addition, there has also been another problem that even if the integral gain can be set appropriately, the stability of the control system might be deteriorated depending upon the set value of the proportional gain Kp, and hence such a setting does not contribute to a satisfactory solution.

Moreover, in the fifth patent document, the proportional gain and the integral gain are set to be in inverse proportion to the exhaust gas flow rate, so there arises a further problem as stated below. That is, it is difficult to achieve a control behavior that suits the behavior of the amount of oxygen storage of the catalyst, and in addition, a more complicated construction is required so as to prevent hunting by changing a guard value of the control quantity in proportion to the exhaust gas flow rate, or by providing an intermediate target value.

Thus, with the conventional air fuel ratio control apparatuses for an internal combustion engine, in the so-called PID feedback control using proportional calculation, integral calculation and differential calculation, it is impossible to set a control gain with good stability and controllability appropriate for the delay in the oxygen storage operation of the catalyst, so there is a problem that the state of purification of the catalyst can not be kept adequately with good controllability.

SUMMARY OF THE INVENTION

In view of the above, the present invention is intended to obviate the problems as referred to above, and has for its object to obtain an air fuel ratio control apparatus for an internal combustion engine which is capable of achieving control behavior with good stability and response appropriate for a delay in an oxygen storage operation of a catalyst and of always keeping the state of purification of the catalyst in an adequate manner by setting an integral gain for integral calculation in feedback control using a downstream oxygen sensor so as to be proportional to the flow rate of an exhaust gas, and by setting a proportional gain for proportional calculation so as not to be changed due to the exhaust gas flow rate.

Bearing the above object in mind, an air fuel ratio control apparatus for an internal combustion engine according to the present invention includes: a catalyst that is arranged in an exhaust system of an internal combustion engine for purifying an exhaust gas from the internal combustion engine; an upstream air fuel ratio sensor that is arranged at a location upstream of the catalyst for detecting an air fuel ratio in an upstream exhaust gas upstream of the catalyst; a downstream air fuel ratio sensor that is arranged at a location downstream of the catalyst for detecting an air fuel ratio in a downstream exhaust gas downstream of the catalyst; a first air fuel ratio feedback control section that adjusts an amount of fuel supplied to the internal combustion engine in accordance with the air fuel ratio detected by the upstream air fuel ratio sensor and an upstream target air fuel ratio so as to make the air fuel ratio in the upstream exhaust gas and the upstream target air fuel ratio coincide with each other; and a second air fuel ratio feedback control section that operates, by using at least proportional calculation and integral calculation, the upstream target air fuel ratio in accordance with an air fuel ratio deviation between the air fuel ratio detected by the downstream air fuel ratio sensor and a downstream target air fuel ratio so as to make the detected air fuel ratio of the downstream air fuel ratio sensor and the downstream target air fuel ratio coincide with each other. The second air fuel ratio feedback control section sets an integral gain of the integral calculation to be larger or an update period of the integral calculation to be smaller in accordance with an increasing flow rate of the exhaust gas, so that a change rate of the integral calculation with respect to the air fuel ratio deviation is increased. The second air fuel ratio feedback control section also sets a proportional gain of the proportional calculation so as not to be changed with respect to a change in the flow rate of the exhaust gas.

According to the present invention, it is possible to achieve control behavior with good stability and response appropriate for a delay in an oxygen storage operation of the catalyst, and it is also possible to always keep the state of purification of the catalyst adequately.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail while referring to the accompanying drawings.

Embodiment 1

Figure 1:
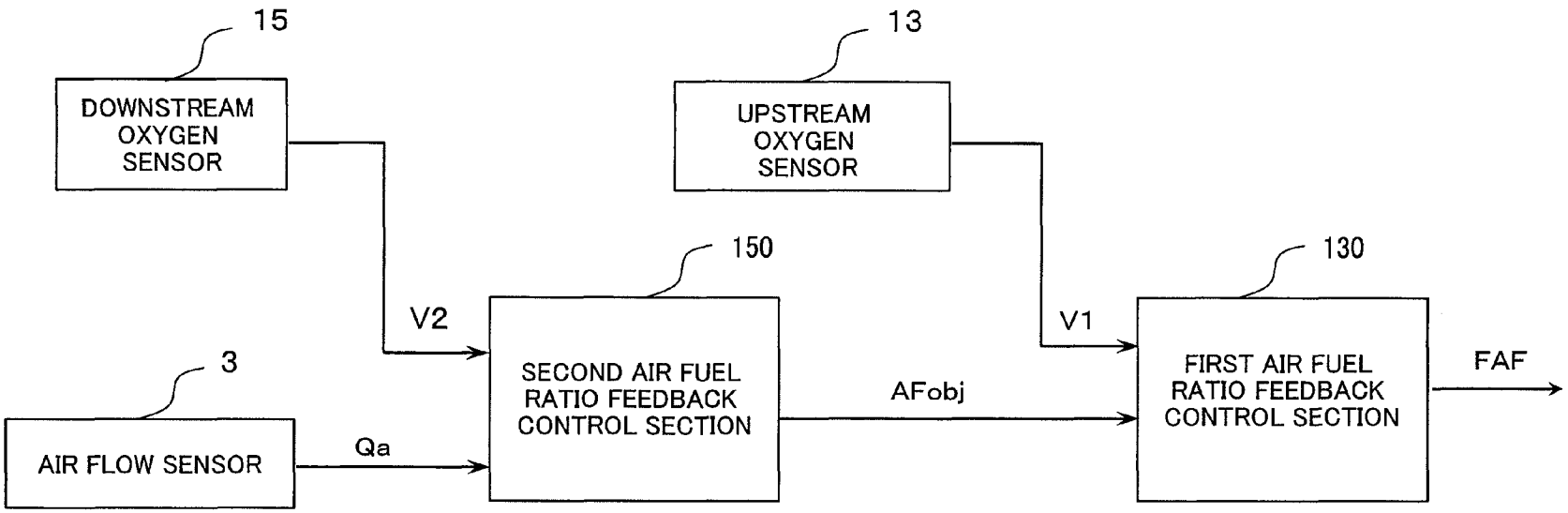
FIG. 1 is a block diagram showing the construction of essential portions of an air fuel ratio control apparatus for an internal combustion engine according to a first embodiment of the present invention.

Referring to the drawings and first to FIG. 1, there is shown, in a block diagram, the construction of sentential portions of an air fuel ratio control apparatus for an internal combustion engine according to a first embodiment of the present invention.

In FIG. 1, the air fuel ratio control apparatus for an internal combustion engine includes an air flow sensor 3 for detecting an amount of intake air Qa sucked to the internal combustion engine (hereinafter also referred to as an engine), an upstream oxygen sensor 13 disposed at an upstream side of a catalyst, a downstream oxygen sensor 15 disposed at a downstream side of the catalyst, a first air fuel ratio feedback control section 130, and a second air fuel ratio feedback control section 150.

The first and second air fuel ratio feedback control sections 130, 150 are constituted by a control circuit 10 (to be described later together with FIG. 2). An output value V1 of the upstream oxygen sensor 13 is input to the first air fuel ratio feedback control section 130, and an output value V2 of the downstream oxygen sensor 15 is input to the second air fuel ratio feedback control section 150.

The second air fuel ratio feedback control section 150 calculates an upstream target air fuel ratio AFobj based on the output value (voltage signal) V2 of the downstream oxygen sensor 15 and the amount of intake air Qa from the air flow sensor 3.

At this time, the second air fuel ratio feedback control section 150 calculates an upstream target air fuel ratio AFobj according to proportional calculation and integral calculation in such a manner that the output value V2 of the downstream oxygen sensor 15 coincides with a second target value (hereinafter referred to simply as a "target value")VR2. Here, note that a proportional gain of the proportional calculation is set so as not to be changed by the flow rate of exhaust gas qa (equal to the amount of intake air Qa), and an integral gain of the integral calculation is set so as to be proportional to the flow rate of exhaust gas qa.

The first air fuel ratio feedback control section 130 generates an air fuel ratio correction factor FAF based on the output value V1 of the upstream oxygen sensor (voltage signal) 13 and the upstream target air fuel ratio AFobj from the second air fuel ratio feedback control section 150, and inputs it to a fuel injection control section (to be described later).

Figure 2:
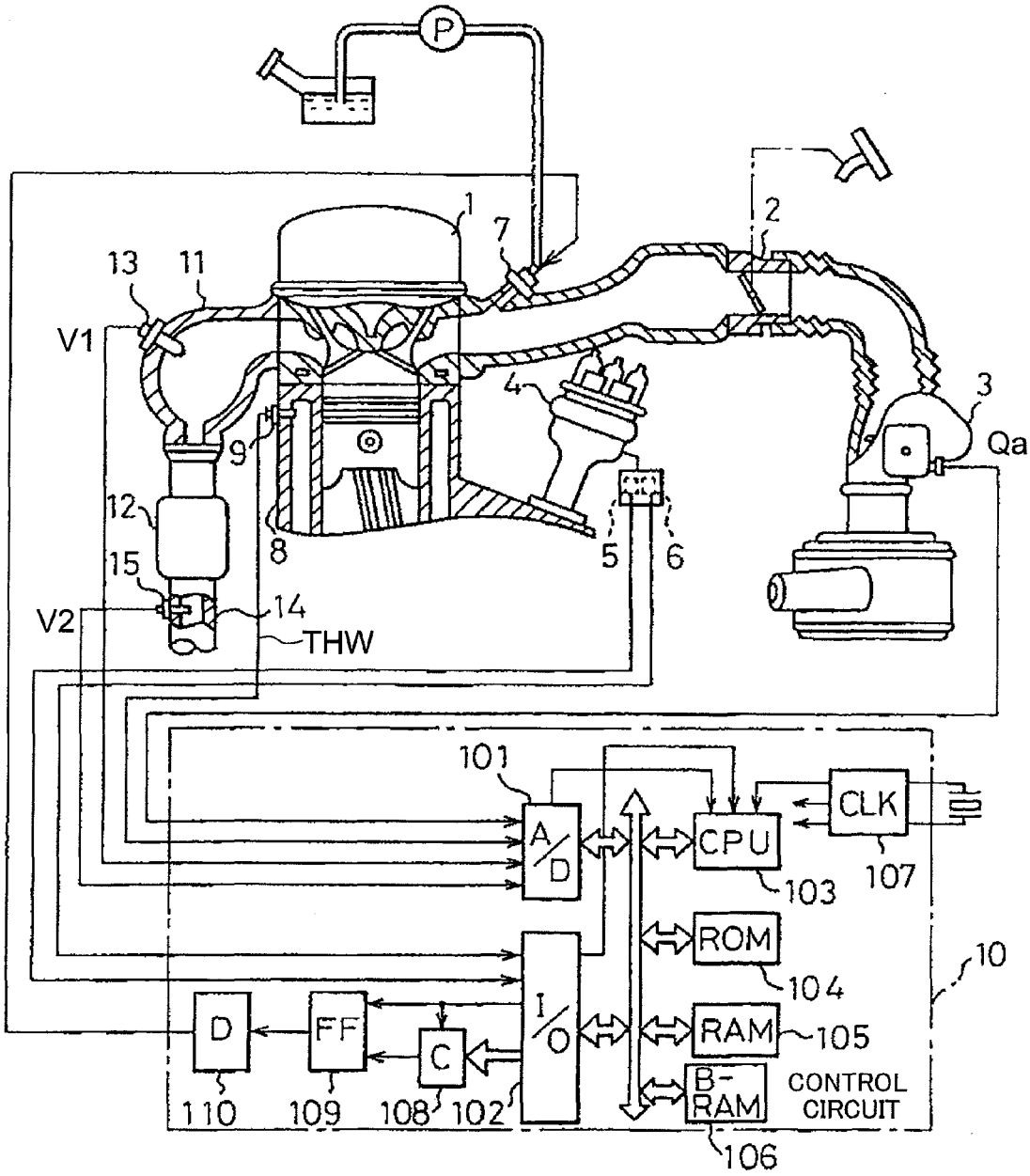
FIG. 2 is an overall construction view showing the air fuel ratio control apparatus for an internal combustion engine according to the first embodiment of the present invention.

FIG. 2 is an overall construction view that shows the air fuel ratio control apparatus for an internal combustion engine according to the first embodiment of the present invention, and the same or like parts or elements as those described above (see FIG. 1) are identified by the same symbols.

In FIG. 2, the air flow sensor 3 is arranged in an intake passage 2 of an engine (engine proper) 1 that constitutes the internal combustion engine. The air flow sensor 3 has a hot wire built therein for directly measuring the amount of intake air Qa sucked into the engine proper 1, and generates an output signal (analog voltage) proportional to the amount of intake air Qa. The output signal of the air flow sensor 3 is supplied to an A/D converter 101 of the type having a built-in multiplexer in a control circuit 10 comprising a microcomputer.

A distributor 4 related to ignition control on a plurality of cylinders is arranged in the engine 1, and has a pair of crank angle sensors 5, 6 arranged therein. One crank angle sensor 5 generates a pulse signal for reference position detection at intervals corresponding to every crank angle of 720 degrees, and the other crank angle sensor 6 generates a pulse signal for reference position detection at intervals corresponding to every crank angle of 30 degrees. The individual pulse signals of the crank angle sensors 5, 6 are supplied to an input/output interface 102 in the control circuit 10, and the output signal of the crank angle sensor 6 is also supplied to an interruption terminal of a CPU 103.

The fuel injection valves 7 for supplying pressurized fuel from a fuel supply system to the individual cylinders, respectively, are arranged in the intake passage 2 of the engine proper 1. In addition, a water temperature sensor 9 for detecting the temperature of cooling water THW is arranged in a water jacket 8 of a cylinder block of the engine proper 1. The water temperature sensor 9 generates an electric signal (analog voltage) corresponding to the cooling water temperature THW. The electric signal indicative of the cooling water temperature THW output from the water temperature sensor 9 is supplied to the A/D converter 101 in the control circuit 10.

A catalyst (i.e., a catalytic converter having a three way catalyst received therein) 12 for purifying three harmful components HC, CO, NOx in an exhaust gas at the same time is arranged in an exhaust system at a location downstream of an exhaust manifold 11 of the engine proper 1. The upstream oxygen sensor (upstream air fuel ratio sensor) 13 is arranged in the exhaust manifold 11 at a location upstream of the catalyst 12, and the downstream oxygen sensor (downstream air fuel ratio sensor) 15 is arranged in an exhaust pipe 14 downstream of the catalyst 12.

The individual oxygen sensors 13, 15 generate electric signals (voltage signals) corresponding to the air fuel ratios in the exhaust gas upstream and downstream of the catalyst 12 as output values V1, V2, respectively. The output values V1, V2 of the individual oxygen sensors 13, 15 varying in accordance with the air fuel ratios-are input to the A/D converter 101 in the control circuit 10.

Figure 3:
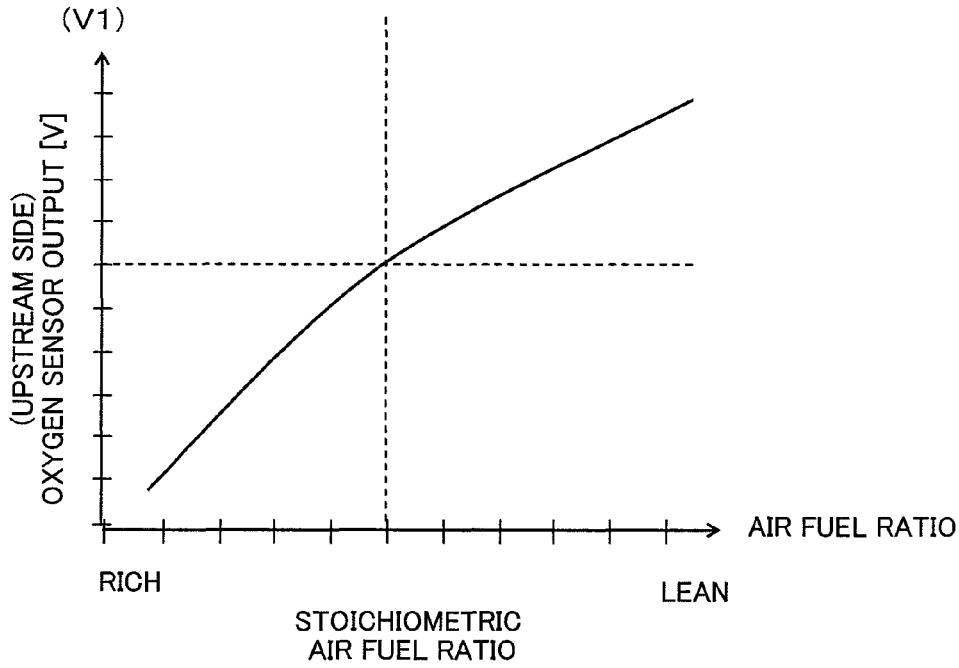
FIG. 3 is an explanatory view showing the output characteristic of a general linear type oxygen sensor.
Figure 4:
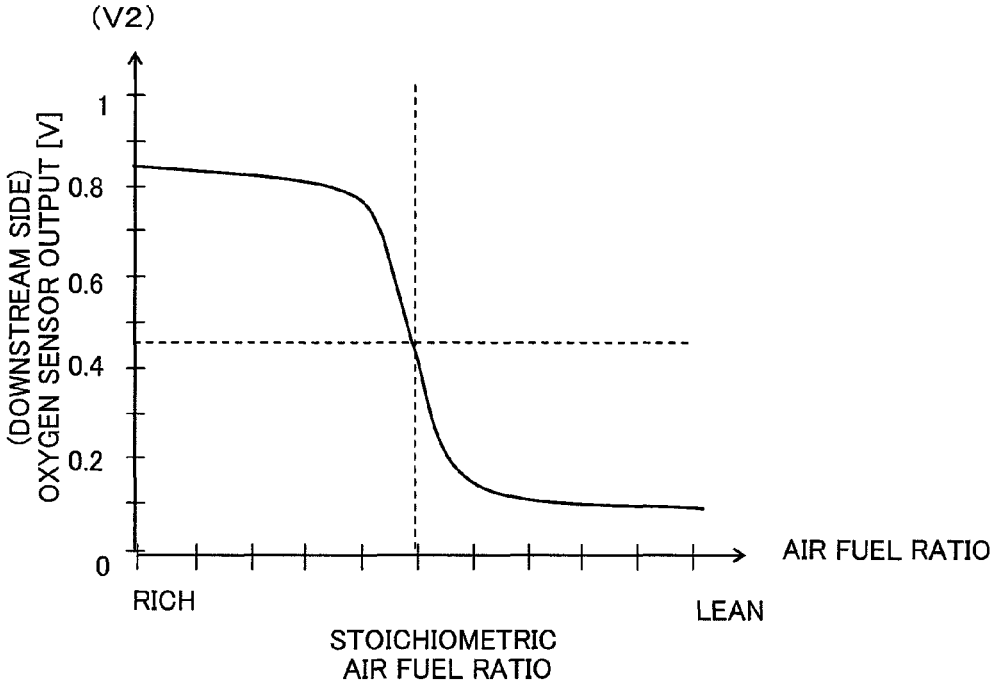
FIG. 4 is an explanatory view showing the output characteristic of a general λ type oxygen sensor.

FIG. 3 is an explanatory view that shows the output characteristic of a general linear type oxygen sensor, and FIG. 4 is an explanatory view that shows the output characteristic of a general λ type oxygen sensor.

The linear type oxygen sensor having a linear output characteristic with respect to a change in the air fuel ratio (see FIG. 3) is used as the upstream oxygen sensor 13, and the λ type oxygen sensor having a characteristic in which its output rapidly changes in the vicinity of the stoichiometric air fuel ratio (see FIG. 4) is used for the downstream oxygen sensor 15.

Reverting to FIG. 2, the control circuit 10 is provided with a ROM 104, a RAM 105, a backup RAM 106, a clock generation circuit 107, drive units 108, 109, 110 and so on, in addition to the AID converter 101, the input/output interface 102 and the CPU 103. The CPU 103, the ROM 104 and the RAM 105 in the control circuit 10 together constitute the first and second air fuel ratio feedback control sections 130, 150 (see FIG. 1), and the drive units 108, 109, 110 constitute the fuel injection control section.

The fuel injection control section in the control circuit 10 adjusts the air fuel ratio of a mixture supplied to the engine 1 to a target value by controlling an excitation driving section (not shown) of each fuel injection valve 7 based on the air fuel ratio correction factor FAF (a value corresponding to the upstream target air fuel ratio AFobj) from the above-mentioned first air fuel ratio feedback control section 130 (see FIG. 1).

Detected information from various kinds of sensors (the air flow sensor 3, the crank angle sensors 5, 6, the temperature sensor 9, etc.), which represents the operating condition of the engine 1, is input to the control circuit 10. The various kinds of sensors include a pressure sensor (not shown) or the like that is arranged at a location downstream of a throttle valve in the intake passage 2.

When amounts of fuel to be supplied Qfuel (to be described later) are calculated in the control circuit 10, the fuel injection valves 7 are driven by the drive units 108, 109, 110, so that amounts of fuel corresponding to the thus calculated amounts of fuel to be supplied Qfuel are sent to the combustion chambers of the corresponding individual cylinders of the engine 1. Here, note that the interruption to the CPU 103 is carried out at the time of completion of the A/D conversion of the A/D converter 101, or at the time of receipt of a pulse signal from the crank angle sensor 6 through the input/output interface 102, or at the time of receipt of an interruption signal from the clock generation circuit 107, or the like times.

The amount of intake air Qa from the air flow sensor 3 and the cooling water temperature THW from the water temperature sensor 9 are taken in according to an A/D conversion routine (executed by the A/D converter 101 at predetermined time intervals), and stored in predetermined regions of the RAM 105. In other words, the amount of intake air Qa and the cooling water temperature THW in the RAM 105 are updated at the predetermined time intervals. The amount of intake air Qa becomes equal to the flow rate of exhaust gas qa that flows into the catalyst 12. In addition, the engine rotational speed Ne is calculated at every interruption of 30 degrees CA of the crank angle sensor 6 and stored in a predetermined region of the RAM 105.

Next, the operation of this first embodiment of the present invention illustrated in FIGS. 1 and 2 will be described. First of all, the operation of the first air fuel ratio feedback control section 130 will be described while referring to FIG. 5.

Figure 5:
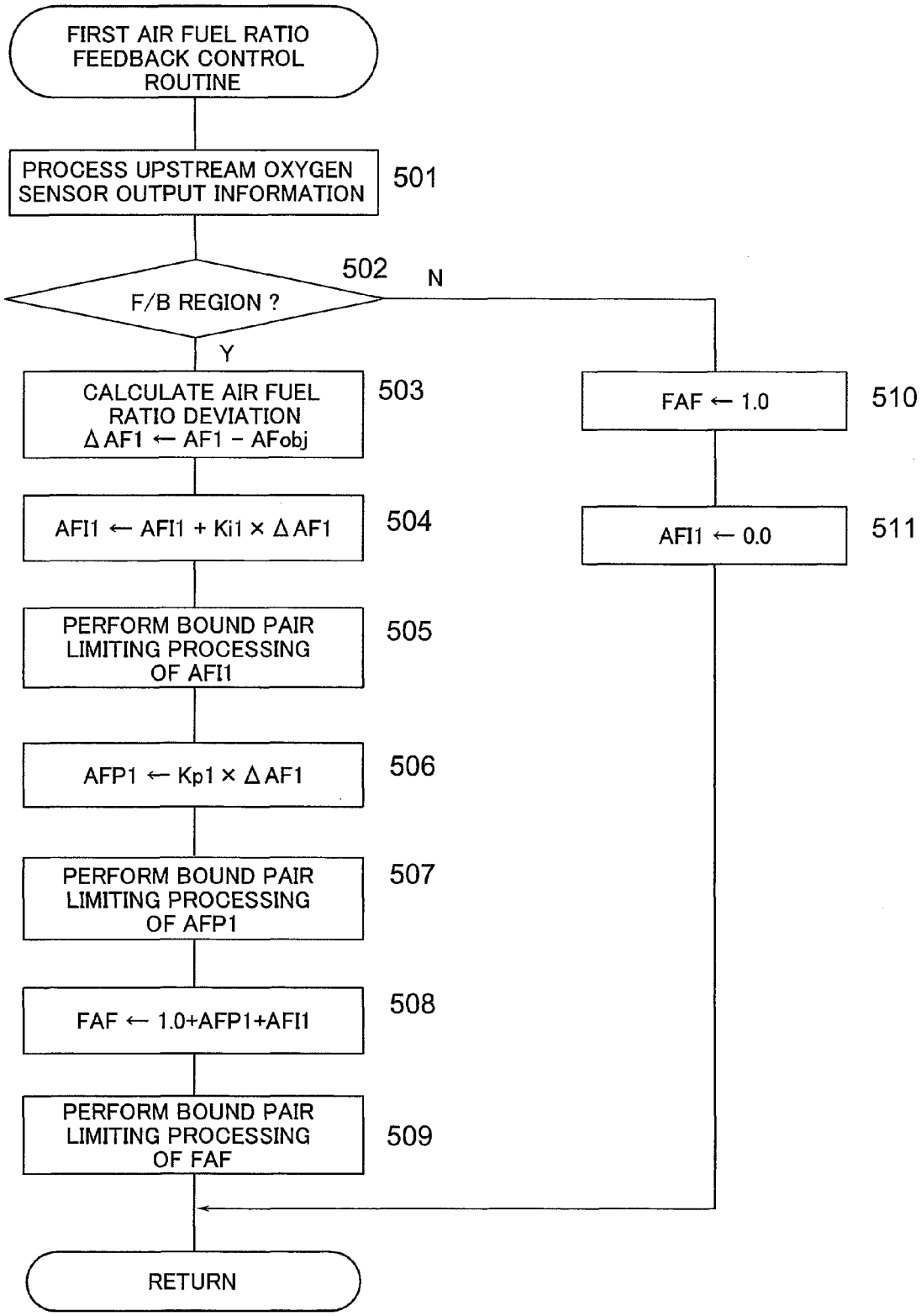
FIG. 5 is a flow chart illustrating a first air fuel ratio feedback control operation according to the first embodiment of the present invention.

FIG. 5 shows a first air fuel ratio feedback control routine according to the control circuit 10, and more specifically shows the calculation processing of the air fuel ratio correction factor FAF based on the output value V1 of the upstream oxygen sensor 13. The control routine of FIG. 5 is executed at every predetermined time (e.g., 5 msec).

In FIG. 5, symbols "Y", "N" at branched portions from each determination process represent determination results of the determination process "Yes", "No", respectively.

First of all, the first air fuel ratio feedback control section 130 in the control circuit 10 executes the processing of upstream oxygen sensor output information (step 501). That is, the first air fuel ratio feedback control section 130 takes in the output value V1 of the upstream oxygen sensor 13 while converting it from analog into digital form, and converts the output value V1 into a detected upstream air fuel ratio AF1 by using a characteristic map between the sensor output value V1 and the air fuel ratio (see FIG. 3).

Subsequently, the first air fuel ratio feedback control section 130 determines whether a closed-loop condition of the air fuel ratio according to the upstream oxygen sensor 13 holds (i.e., the air fuel ratio detected by the upstream oxygen sensor 13 is in an air fuel ratio feedback region) (step 502).

As a specific determination condition in step 502, there is enumerated, for example, an inactive state of the upstream oxygen sensor 13 in the case of an air fuel ratio control condition other than stoichiometric air fuel ratio control, or a failed state of the upstream oxygen sensor 13, or the like. In these cases, it is determined as "the closed-loop condition does not hold", whereas in the other cases, it is determined as "the closed-loop condition holds".

Here, note that as the air fuel ratio control condition other than stoichiometric air fuel ratio control, there are enumerated the following conditions for example: during engine starting, during fuel enriching control at low water temperatures, during fuel enriching control for increasing power under a high load, during fuel leaning control for improvements in fuel consumption or mileage, during fuel leaning control after engine starting, during fuel cut operation, and so on.

When it is determined in step 502 that the closed-loop condition does not hold (that is, No), the air fuel ratio correction factor FAF is set to "1.0" (step 510), and a first integral calculation value AFI1 is reset to "0.0" (step 511), after which the control routine of FIG. 5 is terminated, and a return is performed.

Here, note that in step 510, the air fuel ratio correction factor FAF may be set to a learned value (to be described later) of the air fuel ratio correction factor FAF, instead of being set to "1.0".

On the other hand, when it is determined in step 502 that the closed-loop condition holds (that is, Yes), an air fuel ratio deviation ΔAF1 between the air fuel ratio AF1 detected by the upstream oxygen sensor 13 and the upstream target air fuel ratio AFobj calculated by the second air fuel ratio feedback control section 150 is calculated according to the following expression (5) (step 503).

$$\Delta AF1 = AF1 - AFobj \tag{5}$$

Hereinafter, in steps 504 through 509, the first air fuel ratio feedback control section 130 executes PI control processing comprising a proportional calculation (hereinafter being denoted as "P") and an integral calculation (hereinafter being denoted as "I") in accordance with the air fuel ratio deviation ΔAF1, and sets a control output that cancels the air fuel ratio deviation ΔAF1.

For example, when the air fuel ratio AF1 detected by the upstream oxygen sensor 13 is smaller than the upstream target air fuel ratio AFobj (being at a rich side), the air fuel ratio correction factor FAF is set in a direction to decrease the amount of fuel to be supplied Qfuel, so that it acts to restore the air fuel ratio AF1 to the upstream target air fuel ratio AFobj. The air fuel ratio correction factor FAF is calculated by means of a general PI controller, as shown in the following expression (6).

$$FAF = 1.0 + \Sigma(Ki1 \times \Delta AF1) + Kp1 \times \Delta AF1 \tag{6}$$

Here, note that in expression (6) above, Ki1 is a first integral gain, and Kp1 is a first proportional gain, and the individual gains Ki1, Kp1 are set for each engine operating condition so as to make the feedback control good or adequate.

Now, the PI calculation processing (steps 504 through 509) corresponding to the air fuel ratio deviation ΔAF1 will be specifically described.

The first air fuel ratio feedback control section 130 first executes integral calculation processing (step 504) to obtain the first integral calculation value AFI1 according to the following expression (7).

$$AFI1 = AFI1 + Ki1 \times \Delta AF1 \tag{7}$$

The first integral calculation value AFI1 represented by expression (7) above corresponds to Σ(Ki1×ΔAF1) in the above-mentioned expression (6). The first integral gain Ki1 is set for each engine operating condition and specifically it is set so as to comply with the response of the object to be controlled that is changed depending on the engine operating condition, thereby making feedback controllability good.

Subsequently, bound pair limiting processing on the first integral calculation value AFI1 is performed as shown in the following expression (8) (step 505).

$$AFI1min < AFI1 < AFI1max \tag{8}$$

By performing the bound pair limiting processing as shown in expression (8) above, it it possible to prevent an excessively large fuel operation.

Then, the first air fuel ratio feedback control section 130 executes proportional calculation processing (step 506) to obtain a first proportional calculation value AFP1 according to the following expression (9).

$$AFP1 = Kp1 \times \Delta AF1 \tag{9}$$

In expression (9) above, the first proportional gain Kp1 is set for each engine operating condition, and specifically it is set so as to comply with the response of the object to be controlled that is changed depending on the engine operating condition, thereby making feedback controllability good.

Subsequently, bound pair limiting processing on the first proportional calculation value AFP1 is performed as shown in the following expression (10) (step 507).

$$AFP1min<AFP1<AFP1max \quad (10)$$

By performing the bound pair limiting processing as shown in expression (10) above, it it possible to prevent an excessively large fuel operation.

Then, the first PI calculation values obtained in steps 504 through 507 are summed up or totaled to calculate the air fuel ratio correction factor FAF, as shown in the following expression (11) (step 508).

$$FAF=1.0+AFP1+AFI1 \quad (11)$$

In expression (11) above, the air fuel ratio correction factor FAF is calculated by setting a central value to "1.0", but the air fuel ratio correction factor FAF may be set as a learnt value. Here, note that the learnt value of the air fuel ratio correction factor FAF is a value which is obtained by calculating an annealed value (or an average value) of the air fuel ratio correction factor FAF for each engine operating condition, and which is able to compensate for a shift or deviation of the air fuel ratio correction factor FAF.

Finally, bound pair limiting processing on the air fuel ratio correction factor FAF is executed as shown in the following expression (12) (step 509), and the control routine of FIG. 5 is then terminated.

$$FAFmin<FAF<FAFmax \quad (12)$$

An excessively large fuel operation can be prevented by the above-mentioned calculation processing, thereby making it possible to prevent deterioration in drivability, etc.

Hereinafter, the fuel injection valves 7 are driven by the fuel injection control section in the control circuit 10, so that the amounts of fuel Qfuel to be supplied to the engine 1 are adjusted in accordance with the air fuel ratio correction factor FAF, as shown in the following expression (13).

$$Qfuel1=Qfuel0\times FAF \quad (13)$$

As a result, the air fuel ratio of the engine 1 is controlled to an optimal target air fuel ratio.

In expression (13) above, Qfuel0 is a basic fuel amount, and is calculated as shown in the following expression (14).

$$Qfuel0=Qacyl/\text{target air fuel ratio} \quad (14)$$

In expression (14) above, Qacyl is an amount of air supplied to the engine 1, which is calculated based on the amount of intake air Qa detected by the air flow sensor 3. In is In addition, the target air fuel ratio in the above expression (14) is set by a two-dimensional map that is decided in accordance with the number of revolutions per minute and the load is the engine 1.

Figure 6:
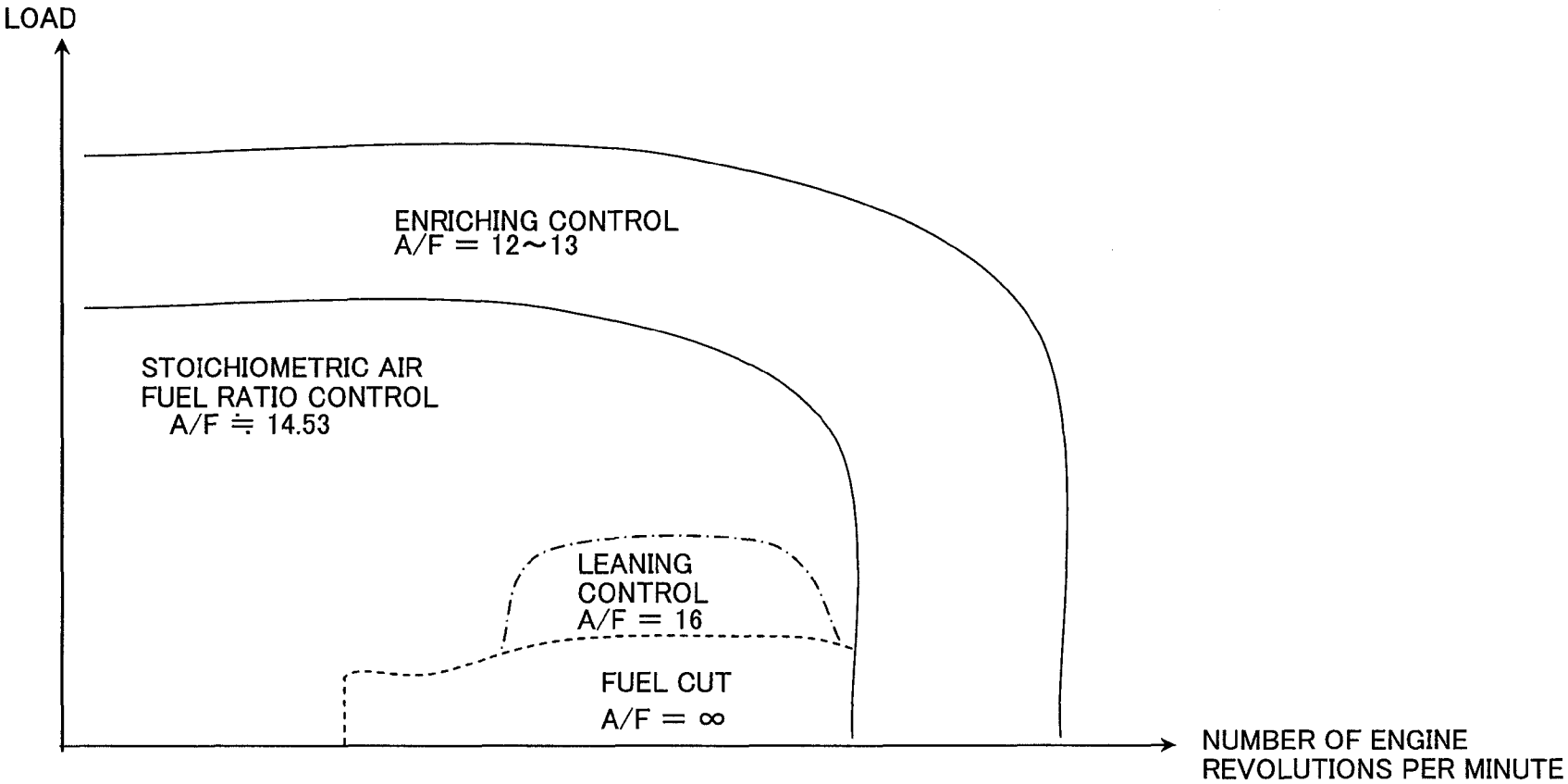
FIG. 6 is an explanatory view showing a target air fuel ratio that is variably set in accordance with a general engine operating condition.

FIG. 6 is an explanatory view showing the two-dimensional map that sets a target air fuel ratio A/F for calculating the basic fuel amount Qfuel0, wherein the axis of abscissa represents the number of engine revolutions per minute, and the axis of ordinate represents the engine load.

In FIG. 6, the target air fuel ratio A/F is set to a value (A/F=12−13) for air fuel ratio enriching control as the number of engine revolutions per minute and the load increase, and it is set to a value (A/F≈14.53) for stoichiometric air fuel ratio control in an engine operating range in which the number of engine revolutions per minute and the engine load are small.

Also, the target air fuel ratio A/F is set to a value (A/F=16) for air fuel ratio leaning control in an engine operating range in which the number of engine revolutions per minute is in an immediate range and the load is low (see an alternate long and short dash line), and in addition, the target air fuel ratio A/F is set to a value (A/F=∞) for fuel cut control in an engine operating range in which the load is low (see a broken line).

In case of the stoichiometric air fuel ratio control, the target air fuel ratio A/F is set to the upstream target air fuel ratio AFobj that is calculated by the second air fuel ratio feedback control section 150, so that the target air fuel ratio A/F thus set is reflected in a feedforward manner.

As a result, a feedback follow-up delay occurring upon a change of the target air fuel ratio can be improved, and the air fuel ratio correction factor FAF can be maintained at a value in the vicinity of its central value of "1.0".

Moreover, learnt value calculation processing is performed for the air fuel ratio correction factor FAF so as to absorb a change with the lapse of time and a production variation of component elements related to the first air fuel ratio feedback control section 130, so the stability of the air fuel ratio correction factor FAF is increased by feedforward correction, and hence the accuracy of the learnt value of the air fuel ratio correction factor FAF can be improved.

In this regard, note that in case where the air flow sensor 3 is not used, the amount of intake air Qa may be calculated in accordance with an output value of a pressure sensor (not shown) arranged downstream of the throttle valve in the intake passage 2 and the engine rotational speed, or in accordance with the degree of opening of the throttle valve and the engine rotational speed.

Next, reference will be made to the operation of the first air fuel ratio feedback control section 150 while referring to a flow chart in FIG. 7.

Figure 7:
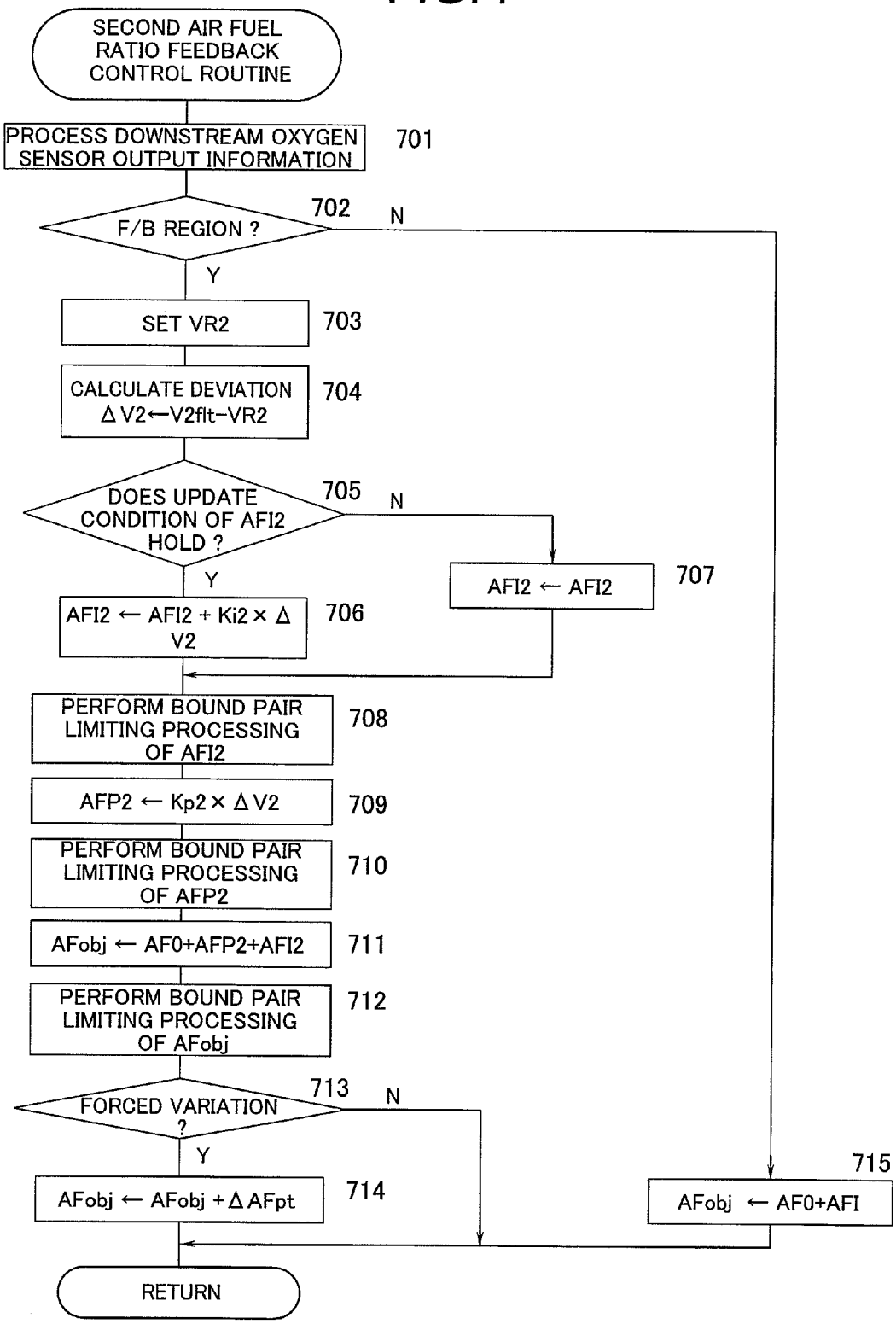
FIG. 7 is a flow chart illustrating a second air fuel ratio feedback control operation according to the first embodiment of the present invention.

FIG. 7 shows a second air fuel ratio feedback control routine according to the control circuit 10, and more specifically shows the calculation processing of the upstream target air fuel ratio FAobj based on the output value V2 of the downstream oxygen sensor 15. The control routine of FIG. 7 is executed at every predetermined time (e.g., 5 msec).

In FIG. 7, first of all, the second air fuel ratio feedback control section 150 in the control circuit 10 executes the processing of downstream oxygen sensor output information (step 701). That is, the second air fuel ratio feedback control section 150 reads in the output value V2 of the downstream oxygen sensor 15, and performs control by using an filtered output value V2flt which is obtained by applying annealing (or gradually changing) processing (filtering or averaging processing, etc.) to the output value V2.

At this time, during a fuel cut operation or in a predetermined period after release or stop of the fuel cut operation, the filter effect is reduced so as to improve the performance to detect a saturation state to the upper limit value of the amount of oxygen storage of the catalyst 12 due to the fuel cut, whereby the filtered output value V2flt is brought close to the actual output value V2 so as to be used for control.

Subsequently, it is determined whether a closed-loop condition of the air fuel ratio according to the downstream oxygen sensor 15 holds (i.e., the air fuel ratio detected by the downstream oxygen sensor 15 is in an air fuel ratio feedback region) (step 702).

As a specific determination condition at this time, there is enumerated, for example, an inactive state of the downstream oxygen sensor 15 in the case of an air fuel ratio control condition other than the stoichiometric air fuel ratio control, or a failed state of the downstream oxygen sensor 15, or the like, and in these cases, it is determined as "the closed-loop condition does not hold", whereas in the other cases, it is determined as "the closed-loop condition holds".

Here, note that as the air fuel ratio control condition other than the stoichiometric air fuel ratio control, there are enumerated the following conditions for example: during engine starting, during fuel enriching control at low water temperatures, during fuel enriching control for increasing power under a high load, during fuel leaning control for improvements in fuel consumption or mileage, during fuel leaning control after engine starting, during fuel cut operation, and so on.

In addition, a determination as to whether the downstream oxygen sensor 15 is active or inactive is made by determining whether a predetermined period of time has elapsed after the engine starting, or whether the level of the output value V2 of the downstream oxygen sensor 15 crosses a predetermined voltage at one time.

When it is determined in step 702 that the closed-loop condition does not hold (that is, No), the upstream target air fuel ratio AFobj is set to an initial value based on an initial value (stoichiometric air fuel ratio) AF0 and a second integral calculation value AFI2 of the downstream air fuel ratio, as shown in the following expression (15) (step 715), and the control routine of FIG. 7 is then terminated.

$$AFobj=AF0+AFI2 \quad (15)$$

In expression (15) above, the initial value AF0 is a value corresponding to the stoichiometric air fuel ratio (=14.53). Also, the second integral calculation value AFI2 is a value immediately before the closed-loop control is terminated, and is held in the backup RAM 106 in the control circuit 10 (see FIG. 2).

The initial value AF0 and the second integral calculation value AFI2 are held for individual operating zones, respectively, which are divided by operating conditions of the engine 1 (e.g., the engine rotational speed, the load and the cooling water temperature THW, etc), wherein the initial value AF0 is a set value, and the second integral calculation value AFI2 of the downstream air fuel ratio is a storage value in the backup RAM 106.

On the other hand, when it is determined in step 702 that the closed-loop condition holds (that is, Yes), the target value VR2 for the output value V2 of the downstream oxygen sensor 15 is set to a predetermined output value (e.g., about 0.45 V) of the downstream oxygen sensor 15 in the vicinity of the stoichiometric air fuel ratio (step 703).

At this time, the target value VR2 may be set to a relatively high voltage (e.g., about 0.75V) that is able to raise the NOx purification rate of the catalyst 12, or it may be set to a relatively low voltage (e.g., about 0.2 V) that is able to raise the purification rates of CO, HC. Further, the target value VR2 may be variably changed in accordance with the engine operating conditions, etc.

In case where the target value VR2 is changed in accordance with the engine operating conditions, annealing (gradually changing) processing (e.g., first order time delay filter processing) may be applied to the target value VR2 so as to alleviate the air fuel ratio variation due to a stepwise change upon the changing of the target value VR2.

Here, note that when the target value VR2 for the output value V2 of the downstream oxygen sensor 15 is changed to be richer or leaner to a great extent, the gain of the sensor output change with respect to a change in the air fuel ratio greatly changes in the output characteristic of the λ type oxygen sensor (see FIG. 4), so there arises an operation similar to what is caused by changing a second proportional gain Kp2 and a second integral gain Ki2 (to be described later).

Accordingly, in case where the target value VR2 is set to be greatly changed in accordance with the engine operating conditions, the output value V2 of the downstream oxygen sensor 15 is converted into a downstream detected air fuel ratio by the output characteristic of the λ type oxygen sensor (see FIG. 4), and an air fuel ratio deviation between the downstream air fuel ratio thus detected and the downstream target air fuel ratio is calculated and may be used for proportional calculation and integral calculation.

Thus, by changing the output value V2 of the downstream oxygen sensor (λ type oxygen sensor) 15 into an air fuel ratio based on the sensor characteristic (see FIG. 4), and by using it for feedback control, the second proportional gain Kp2 and the second integral gain Ki2 are varied in accordance with the change of the downstream target air fuel ratio under the influence of a nonlinear output characteristic of the λ type oxygen sensor, so it is possible to prevent the variation of the behavior of the feedback control.

Thereafter, an output deviation ΔV2 between the target value VR2 for the output value V2 of the downstream oxygen sensor 15 and the filtered output value V2fit is calculated by the following expression (16) (step 704).

$$\Delta V2=V2flt-VR2 \quad (16)$$

Hereinafter, in steps 705 through 711, the second air fuel ratio feedback control section 150 executes PI control processing comprising the proportional calculation (P) and the integral calculation (I) in accordance with the output deviation ΔV2, and sets a control output that cancels the output deviation ΔV2.

For example, when the output value V2 of the downstream oxygen sensor 15 is smaller than the target value (i.e., being in a lean side region), the upstream target air fuel ratio AFobj is set to a rich side, and acts to restore the output value V2 of the downstream oxygen sensor 15 to the target value VR2.

The upstream target air fuel ratio AFobj of the catalyst 12 is calculated by means of a general PI controller by using the initial value AF0, the second integral gain Ki2 and the proportional gain Kp2, as shown in the following expression (17).

$$AFobj=AF0+\Sigma(Ki2\times\Delta V2)+Kp2\times\Delta V2 \quad (17)$$

In expression (17) above, the initial value AF0 is a value (e.g., around 14.53) which is set for each operating condition to correspond to the stoichiometric air fuel ratio, similar to the above-mentioned expression (15).

The proportional calculation generates an output proportional to the output deviation ΔV2 and exhibits a fast response, thus providing an advantageous effect that the output deviation ΔV2 can be restored in a quick manner.

In addition, the larger is the second proportional gain Kp2 set, the larger becomes the absolute value of the amount of proportional operation (=Kp2×ΔV2), and the speed of restoration becomes faster. However, if the second proportional gain Kp2 is set to an excessively large value, the control system reaches a limit of stability and generates hunting. Thus, an appropriate gain setting is needed, as will be described later.

Also, the integral calculation serves to integrate the output deviation ΔV2 to produce an output value, so it operates relatively slowly and has an advantageous effect to eliminate a steady output deviation of the output value V2 of the downstream oxygen sensor 15 resulting from the characteristic variation of the upstream oxygen sensor 13.

The larger is the second integral gain Ki2 set, the larger becomes the absolute value of the amount of operation Σ(Ki2×ΔV2), so the control effect for elimination of the deviation becomes larger. However, if the second integral gain Ki2 is set to the excessively large value, a phase delay becomes large, so the control system reaches the limit of stability and causes hunting. Thus, an appropriate gain setting is needed, as will be described later.

Now, the PI calculation processing (steps 705 through 711) corresponding to the output deviation ΔV2 will be specifically described.

The second air fuel ratio feedback control section 150 first determines whether the update condition for the second integral calculation value AFI2 holds (step 705).

At this time, the update condition for the second integral calculation value AFI2 holds for the operating state of the engine 1 except during a transient operation such as a fuel cut operation and except for a predetermined period after the transient operation.

During the transient operation, the upstream air fuel ratio is disturbed to a great extent and the downstream air fuel ratio is also disturbed, so if integral calculation processing is executed in such a state, incorrect integration will be performed.

In addition, the integral calculation operates relatively slowly, so a wrong or incorrect value is shown for a while after the transient operation, as a result of which the control performance is deteriorated.

Accordingly, during the transient operation, the update of the integral calculation is temporarily stopped, and the second integral calculation value AFI2 is held, thereby preventing incorrect integral calculation.

Further, even after the transient operation, the influence of the air fuel ratio disturbance remains for a while resulting mainly from a delay due to the oxygen storage operation of the catalyst 12, so even in a predetermined period of time after the transient operation, the update of the integral calculation is inhibited. In this case, the predetermined period of time after the transient operation is set to a period until the accumulated or integrated amount of intake air after the transient operation reaches a predetermined value.

This is because the speed at which the amount of oxygen storage of the catalyst 12 is restored is proportional to the amount of intake air Qa. The predetermined value of the integrated amount of air after the fuel cut operation is set to adapt to a fresh catalyst (i.e., the integrated amount of air until the amount of oxygen storage of the catalyst 12 is restored becomes maximum) in order to ensure convergence ability for all catalysts 12 ranging from a new catalyst to a degraded catalyst.

In step 705, when it is determined that the update condition for the second integral calculation value AFI2 holds (that is, YES), the second integral calculation value AFI2 is updated by using an amount of update (=Ki2×ΔV2) based on the second integral gain Ki2, as shown in the following expression (18) (step 706).

$$AFI2(n)=AFI2(n-1)+Ki2\times\Delta V2 \quad (18)$$

In expression (18) above, AFI2(n) is an updated second integral calculation value. Here, note that the last second integral calculation value AFI2(n−1) is held in the backup RAM 106 for each operating condition.

The characteristic variation of the upstream oxygen sensor 13 compensated for by the second integral calculation value AFI2 changes in accordance with the operating condition such as the exhaust gas temperature, exhaust gas pressure, or the like, so the second integral calculation value AFI2 of the downstream air fuel ratio of the catalyst 12 is held in the backup RAM 106 as setting data for each operating condition, and is updated and switched over each time the operating condition changes.

In addition, by holding the second integral calculation value AFI2 in the backup RAM 106, it is possible to prevent the second integral calculation value AFI2 from being reset to reduce control performance upon each stoppage/restart of the engine 1.

On the other hand, when it is determined in step 705 that the update condition of the second integral calculation value AFI2 does not hold (that is, No), the second integral calculation value AFI2 is held at the last value without executing step 706 (i.e., without updating the second integral calculation value AFI2) (step 707).

Here, note that in order to adapt to the delay of the of the oxygen storage operation of the catalyst 12, the second integral gain Ki2 is set so as to be proportional to the flow rate of the exhaust gas qa based on the above-mentioned limit sensitivity method and the property of the delay of the oxygen storage operation, and the second proportional gain Kp2 is set so as not to be changed with respect to the change in the flow rate of the exhaust gas qa.

Figure 19:
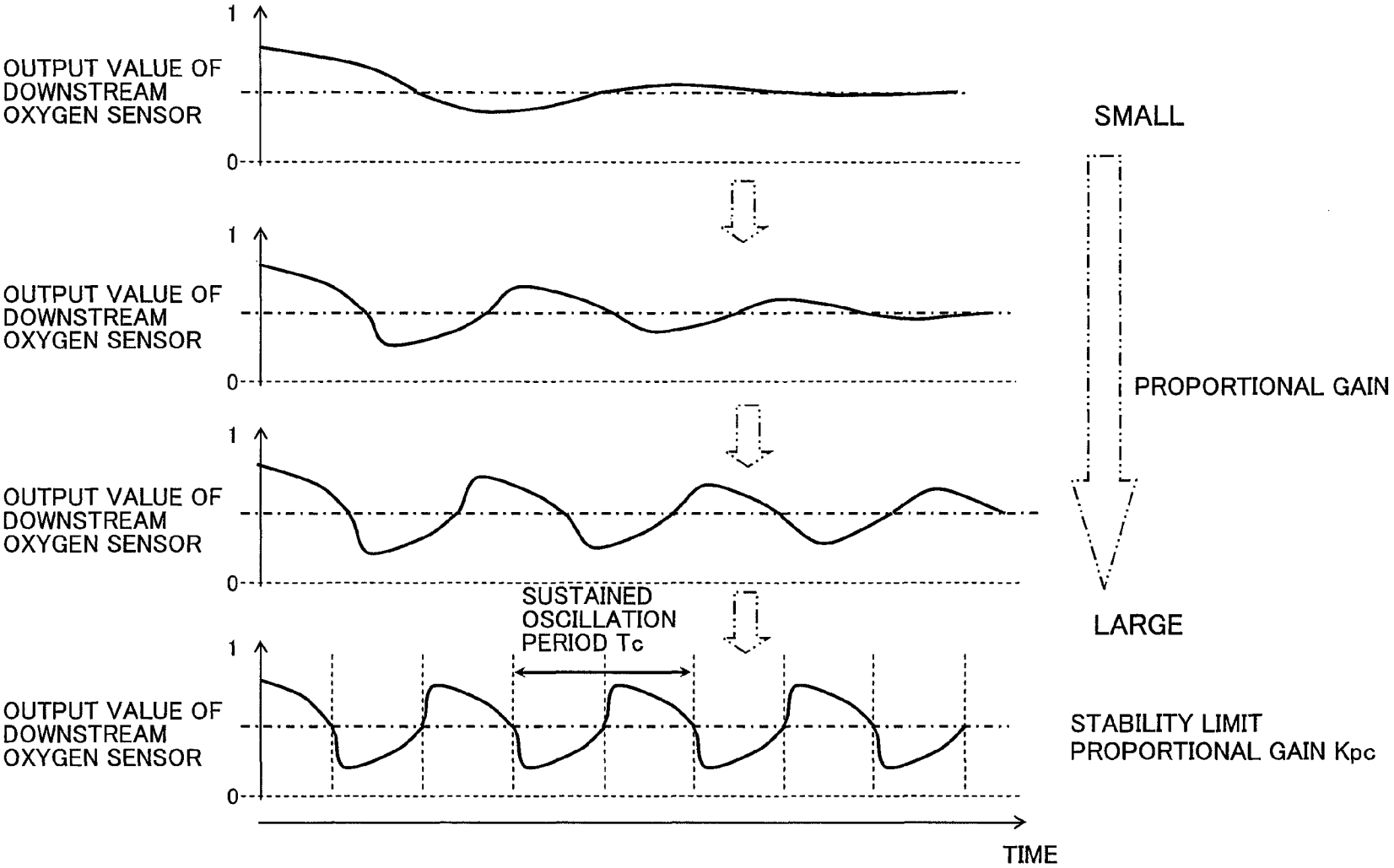
FIG. 19 is a timing chart illustrating the change over time and the limit of stability of an output value of a general downstream oxygen sensor.

The limit sensitivity method is a method of setting individual gains from the proportional gain Kpc for the stability limit at which the second proportional gain Kp2 is gradually increased to start sustained oscillation and the sustained oscillation period Tc, as shown in the above-mentioned FIG. 19 and expressions (2).

Accordingly, appropriate values of the second proportional gain Kp2 and the second integral gain Ki2 are represented as shown by the following expressions (19).

$$Kp2=A\times Kpc$$

$$Ki2=B\times Kpc/Tc \quad (19)$$

Coefficients A, B in expressions (19) above are adjusted to values that are adapted to the kind of the delay of the object to be controlled, and in this case, they are adjusted so as to be adapted to the delay in the oxygen storage operation of the catalyst 12.

The delay in the oxygen storage operation of the catalyst is very large and predominant in comparison with other delays, so the limit of stability depends on the oxygen storage operation. This is because the delay in the oxygen storage operation of the catalyst 12 is designed to be sufficiently large so as to absorb the air fuel ratio variation due to other delays such as the operation delays of the individual oxygen sensors 13, 15, the delay in movement of the exhaust gas in the engine 1, and so on.

The change rate of the amount of oxygen storage of the catalyst 12 is proportional to the amount of change of the air fuel ratio at the upstream side of the catalyst 12 from the stoichiometric air fuel ratio and the flow rate of exhaust gas qa.

Figure 20:
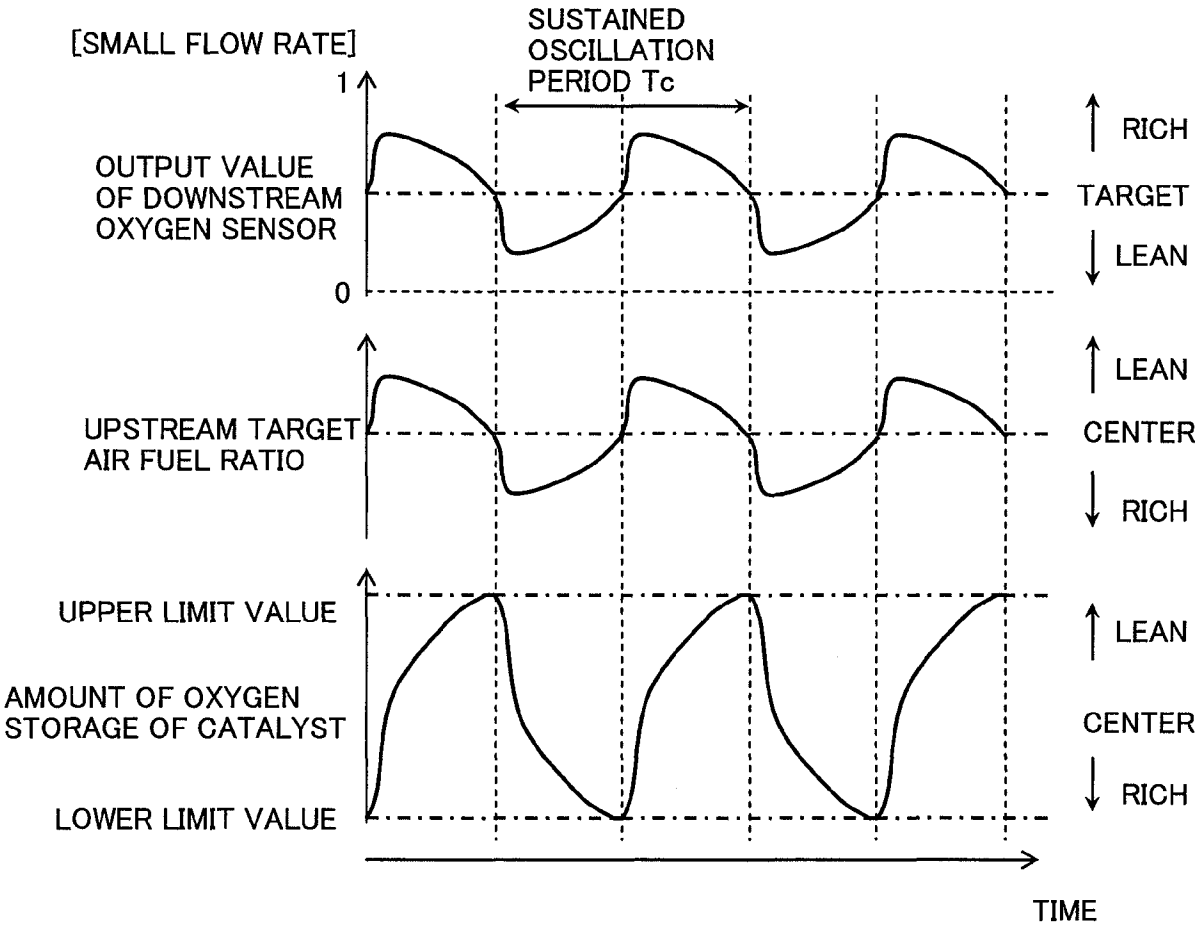
FIG. 20 is a timing chart for explaining an air fuel ratio feedback control behavior when the flow rate of an exhaust gas is generally in a small level.
Figure 21:
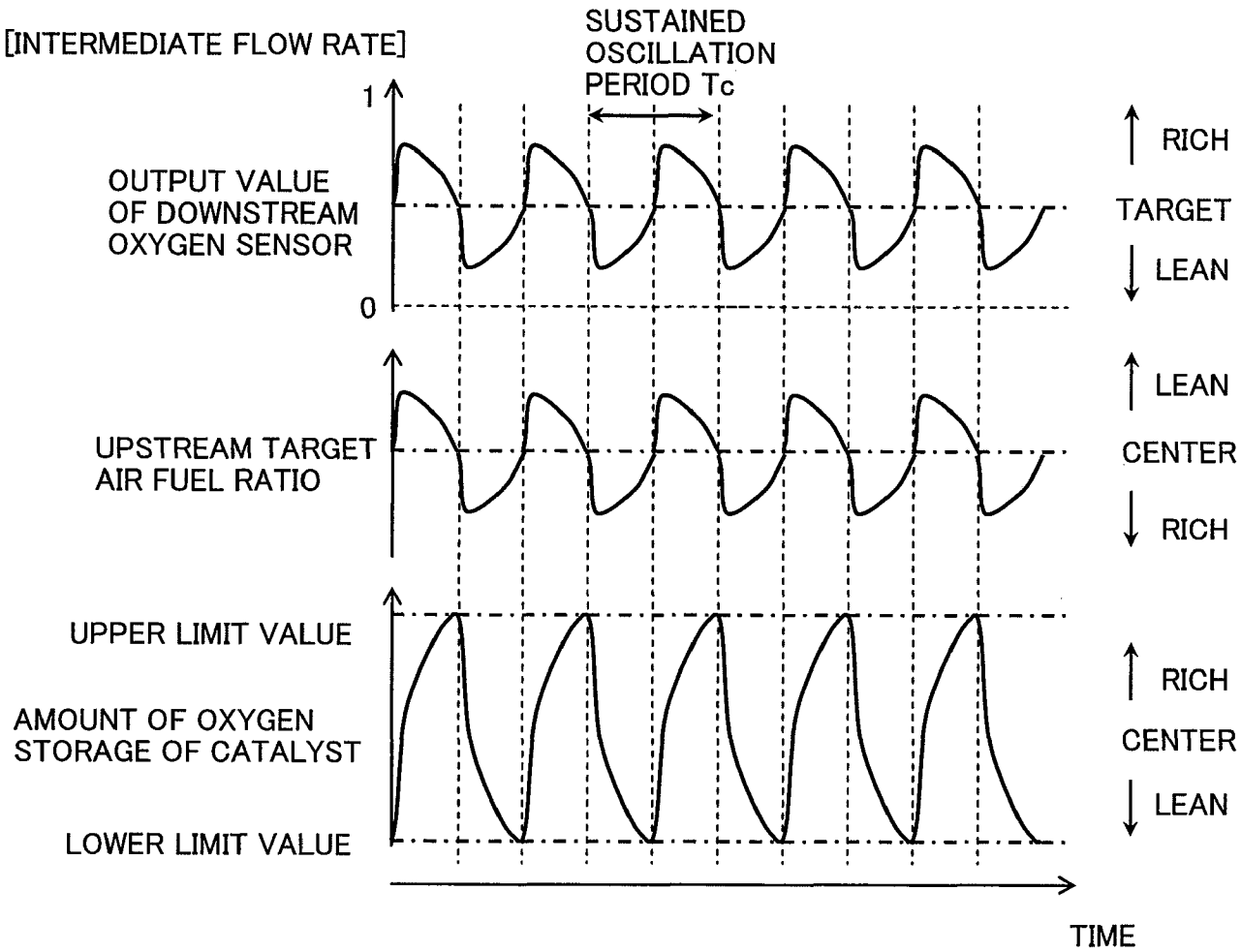
FIG. 21 is a timing chart for explaining an air fuel ratio feedback control behavior when the flow rate of an exhaust gas is generally in an intermediate level.
Figure 22:
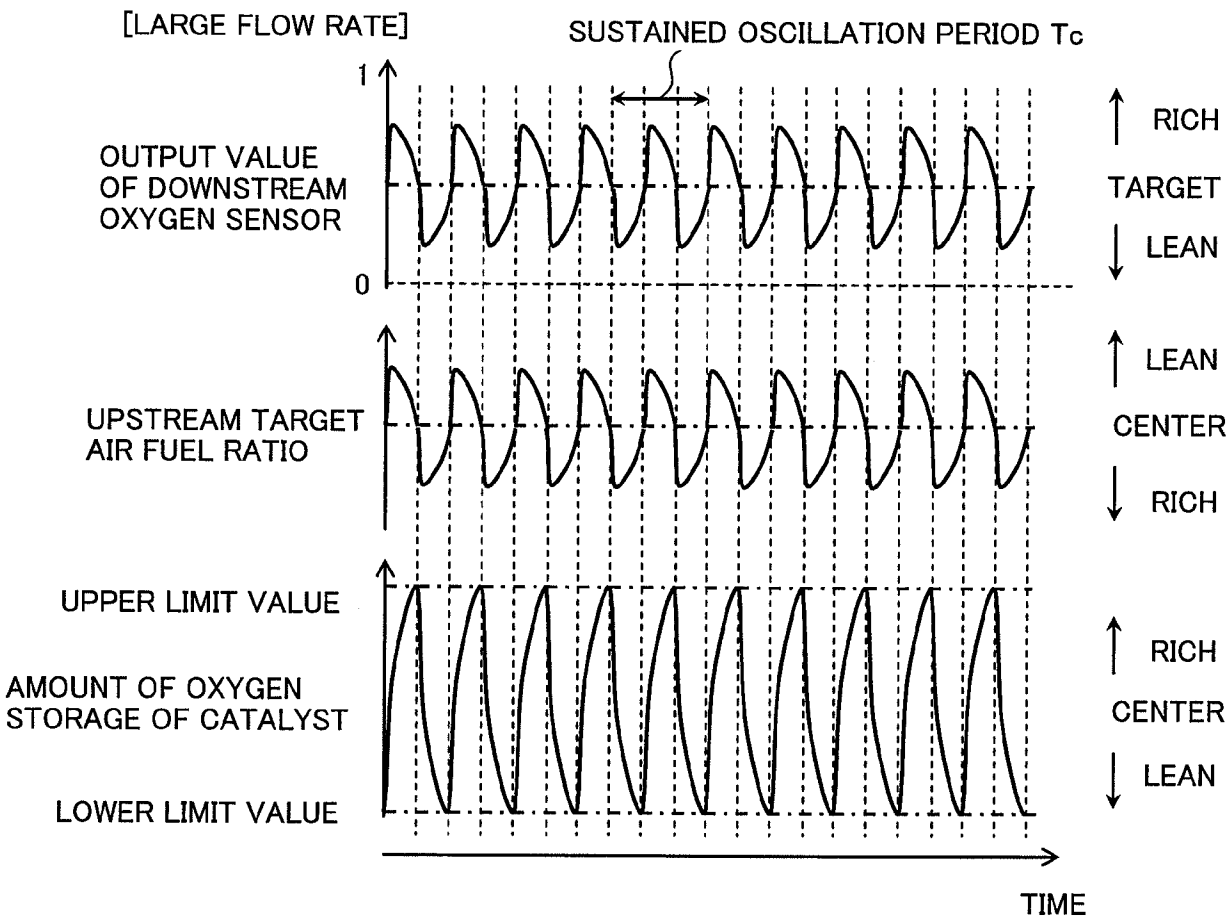
FIG. 22 is a timing chart for explaining an air fuel ratio feedback control behavior when the flow rate of an exhaust gas is generally in a large level.

The behaviors of the limit of stability when the flow rate of exhaust gas qa changes from a small flow rate to an intermediate flow rate and thence to a large flow rate are shown in the above-mentioned FIG. 20 through FIG. 22.

Since the amount of change of the variation of the air fuel ratio upstream of the catalyst 12 is decided in accordance with the magnitude of the proportional gain, the proportional gain Kpc at the stability limit is not changed by the flow rate of exhaust gas qa but indicates a definite value.

On the other hand, the change rate of the amount of oxygen storage is proportional to the flow rate of exhaust gas qa, so the sustained oscillation period Tc shortens as the flow rate of exhaust gas qa increases.

In other words, the proportional gain Kpc and the sustained oscillation period Tc are represented as shown in the following expressions (20).

$$Kpc=\text{constant}$$

$$Tc\propto 1/qa \quad (20)$$

Accordingly, an optimal second proportional gain Kp2 is set so as not to be changed by the flow rate of exhaust gas qa, according to the limit sensitivity method, and an optimal second integral gain Ki2 is set so as to be proportional to the flow rate of exhaust gas qa. These optimal second proportional and integral gains Kp2, Ki2 are respectively represented as shown in the following expressions (21).

$$Kp2=\text{definite value}$$

$$Ki2 \propto qa \tag{21}$$

By setting the second proportional gain Kp2 and the second integral gain Ki2, as shown in expressions (21) above, a control behavior with good stability and response can be achieved in compliance with the delay of the oxygen storage operation of the catalyst 12 that changes in accordance with the flow rate of exhaust gas qa, whereby the state of purification of the catalyst 12 can always be kept adequately.

Here, note that the integral gain is changed with the update period of integral calculation being made as a fixed value, but it is needless to say that even if, on the contrary, the update period may be changed while fixing the integral gain, the result is mathematically equivalent to the above.

That is, when the integral calculation of a continuous system is converted to the integral calculation of a discrete system, a second integral calculation value AFI2(t) based on the integral calculation of the continuous system and a second integral calculation value AFI2(n) based on the integral calculation of the discrete system are represented as shown in the following expressions (22).

$$AFI2(t)=Ki\times\int_0^t \Delta V2(t)dt$$

$$AFI2(n)=AFI2(n-1)+Ki\times\Delta T\times\Delta V2(n) \tag{22}$$

In expressions (22) above, Ki is an integral gain in the continuous system, t is a time in the continuous system, n is the number of updates in the discrete system, and ΔT is an update period. In addition, Ki×ΔT corresponds to the second integral gain Ki2.

For example, the integral gain Ki in the continuous system is set to a value proportional to the flow rate of the exhaust gas qa (i.e., a value obtained by multiplying the flow rate of the exhaust gas qa by a constant A1), for example, as shown in the following expression (23), so as to be adapted to the oxygen storage operation of the catalyst 12.

$$Ki=A1\times qa \tag{23}$$

Accordingly, in the discrete system, the second integral gain Ki2 is represented as shown in the following expression (24).

$$\begin{aligned} Ki2 &= A1\times qa\times A3/qa \\ &= A1\times A3 \end{aligned} \tag{27}$$

In expression (24), assuming that the update period ΔT is a predetermined fixed period (constant A2), the second integral gain Ki2 is represented as shown in the following expression (25).

$$Ki2=A1\times qa\times A2 \tag{25}$$

From expression (25) above, it is found that when the update period ΔT is the fixed value (=A2), the second integral gain Ki2 need only be set to be proportional to the flow rate of exhaust gas qa.

On the other hand, it is assumed that the update period ΔT is set to be in inverse proportion to the flow rate of exhaust gas qa by using a constant A3 for example, as shown in the following expression (26).

$$\Delta T=A3/qa \tag{26}$$

In this case, the second integral gain Ki2 is represented as shown in the following expression (27).

$$\begin{aligned} Ki2 &= Ki\times\Delta T \\ &= A1\times qa\times\Delta T \end{aligned} \tag{24}$$

From expression (27) above, the second integral gain Ki2 may be a fixed set value.

Accordingly, even in cases where the second integral gain Ki2 is set to be proportional to the flow rate of exhaust gas qa, as shown in the above expression (25), and where the second integral gain Ki2 is set to a fixed value, as shown in the above expression (27), instead of setting the update period A T to a fixed value, and where the update period ΔT is set to be in inverse proportion to the flow rate of exhaust gas qa, as shown in the above expression (26), a mathematically similar behavior results.

The setting of the latter can be achieved by the addition of not only the update condition of the second integral calculation value AFI2 in step 705 but also an update condition (not shown) according to timer processing. For example, a timer time is set to be in inverse proportion to the flow rate of the exhaust gas qa, whereby the second integral calculation value AFI2 of the downstream air fuel ratio may be updated each time the timer time has elapsed, and the second proportional gain Kp2 may be set so as not to be changed with respect to the change in the flow rate of the exhaust gas qa.

Thus, even if the second integral gain Ki2 is set to the fixed value and the update period ΔT is set to be in inverse proportion to the flow rate of exhaust gas qa, the change rate of integral calculation with respect to the air fuel ratio deviation comes to be proportional to the flow rate of the exhaust gas qa, so it can be adapted to the oxygen storage behavior of the catalyst 12.

In addition, both the second integral gain Ki2 and the update period ΔT may be changed in accordance with the flow rate of the exhaust gas qa, and the integral gain Ki in the continuous system may be set to be proportional to the flow rate of the exhaust gas qa. Also, the change rate of integral calculation with respect to the air fuel ratio deviation may be set to be proportional to the flow rate of the exhaust gas qa.

Reverting to FIG. 7, following step 707, the second air fuel ratio feedback control section 150 performs bound pair limiting processing on the second integral calculation value AFI2, as shown in the following expression (28) (step 708).

$$AFI2min<AFI2<AFI2max \tag{28}$$

Since the variation width or range of the characteristic of the upstream oxygen sensor 13 can be grasped beforehand, an upper limit value AFI2max and a lower limit value AFI2min are set to appropriate values that are able to compensate for the characteristic variation range. In addition, a tendency changes depending on the engine operating conditions, so the upper and lower limit values AFI2max, AFI2min may be accordingly changed. By processing in this manner, an excessively large quantity of air fuel ratio operation can be prevented.

Then, proportional calculation processing is applied to the output deviation ΔV2 of the downstream oxygen sensor by using the second proportional gain Kp2, as shown in the following expression (29) (step 709), whereby the second proportional calculation value AFP2 is obtained.

$$AFP2=Kp2\times\Delta V2 \quad (29)$$

In consideration of the delay in the oxygen storage operation of the catalyst 12, the second proportional gain Kp2 is set so as not to be changed with respect to the change in the flow rate of the exhaust gas qa, as stated above.

Although the second integral gain Ki2 and the second proportional gain Kp2 are represented as Ki2×ΔV2 and Kp2×ΔV2 by simply using the predetermined gains, respectively, an amount of update may be set in accordance with the output deviation ΔV2, for example, by using a one-dimensional map (by applying a variable gain setting).

Figure 8:
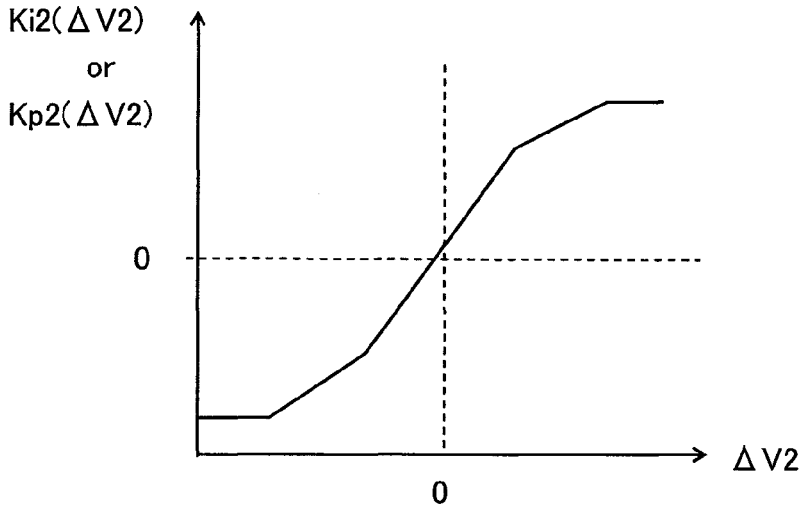
FIG. 8 is an explanatory view showing a specific example of a one-dimensional map of a second integral gain or a proportional gain according to the first embodiment of the present invention.

FIG. 8 is an explanatory view that shows a specific example of the one-dimensional map for each gain, wherein the axis of abscissa is the output deviation ΔV2, and the axis of ordinate is the map value Ki2(ΔV2) of the second integral gain or the map value Kp2(ΔV2) of the second proportional gain. In FIG. 8, the slopes of one-dimensional map values Ki2(ΔV2), Kp2(ΔV2) with respect to the output deviation ΔV2 of the downstream oxygen sensor correspond to the gains thereof.

The second proportional gain Kp2 is set so as not to be changed with respect to the change in the flow rate of the exhaust gas qa, and remains as shown by the characteristic of FIG. 8 without regard to the difference in the flow rate of the exhaust gas qa.

On the other hand, the second integral gain Ki2 is set in a manner such that its slope increases in proportion to the flow rate of the exhaust gas qa.

Figure 9:
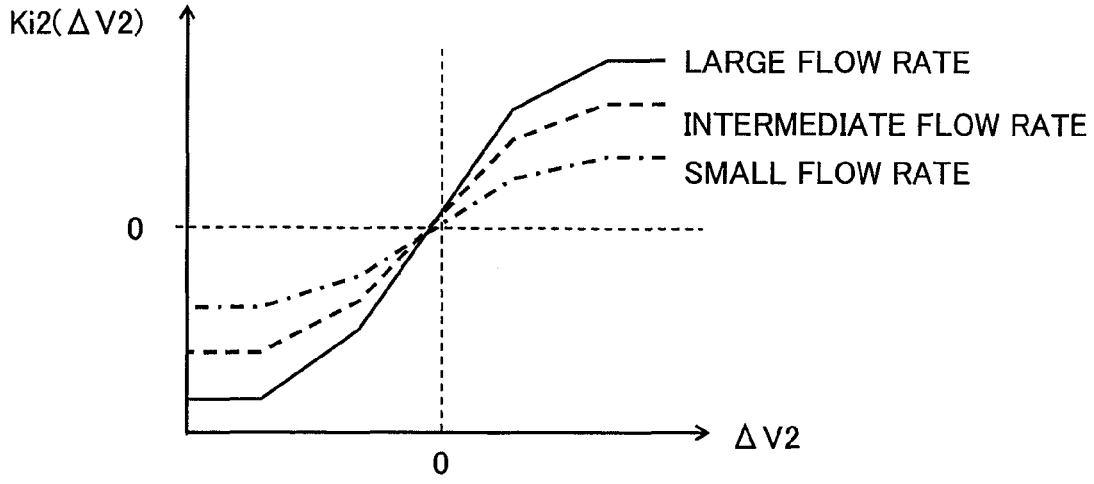
FIG. 9 is an explanatory view showing a specific example of a one-dimensional map of the second integral gain according to the first embodiment of the present invention.

FIG. 9 is an explanatory view that shows characteristics of the map value Ki2(ΔV2) of the second integral gain Ki2 with respect to the flow rate of the exhaust gas qa.

In FIG. 9, the characteristics of the map value Ki2(ΔV2) when the flow rate of the exhaust gas qa is a small level, an intermediate level, and a large level are shown by an alternate long and short dash line, a broken line, and a solid line, respectively.

As shown in FIG. 9, the map value Ki2(ΔV2) of the second integral gain Ki2 is set in a manner such that its slope increases in proportion to the increasing flow rate of the exhaust gas qa.

Although in the above explanation, the second integral gain Ki2 and the proportional gain Kp2 are set to positive values, they may be represented as negative values, for example, as shown in the following expression (30), depending upon the sign of the arithmetic expression of the output deviation ΔV2 between the target value VR2 of the downstream oxygen sensor 15 and the filtered output value.

$$\Delta V2=VR2-V2flt \quad (30)$$

Accordingly, in consideration of the respective gains, the absolute value of the second proportional gain Kp2 is set so as not to be changed with respect to the change in the flow rate of the exhaust gas qa, whereas the absolute value of the second integral gain Ki2 is set so as to increase in proportion to the flow rate of the exhaust gas qa.

Reverting to FIG. 7, following step 709, the second air fuel ratio feedback control section 150 performs bound pair limiting processing on the second proportional calculation value AFP2, as shown in the following expression (31) (step 710).

$$AFP2min<AFP2<AFP2max \quad (31)$$

In expression (31) above, an upper limit value AFP2max and a lower limit value AFP2min are set for each operating condition based on requirements such as drivability, etc. For example, in an idle operating condition, rotational fluctuation or variation is liable to be generated as the amount of operation of the second proportional calculation value AFP2 becomes large, so the upper and lower limit values AFP2max, AFP2min are set such that the operating range of the second proportional calculation value AFP2 becomes narrow.

Here, note that the stability of the air fuel ratio feedback control is decided by the second proportional gain Kp2, so even if the upper and lower limit values AFP2max, AFP2min are changed, no influence is given to control stability and an excessively large amount of operation of the air fuel ratio can be prevented.

In addition, as stated above, in the predetermined period after the transient operation when an update inhibition condition of the second integral calculation value AFI2 holds (i.e., the engine 1 comes into a transient operation condition such as a fuel cut operation), the operating range of the second proportional calculation value AFP2 defined by the upper and lower limit values AFP2max, AFP2min is changed to be increased. As a result, the amount of operation of the air fuel ratio due to the second proportional calculation value AFP2 can be set large, thereby making it possible to hasten the restration speed of the amount of oxygen storage of the catalyst 12 that has been changed by the fuel cut operation.

Here, note that the stability of the air fuel ratio feedback control is decided by the second proportional gain Kp2, so even if the upper and lower limit values AFP2max, AFP2min are changed, no influence is given to control stability, and the controllability of the air fuel ratio after restoration from the fuel cut operation can be improved.

Moreover, in consideration of the fact that the restoration speed of the amount of oxygen storage of the catalyst 12 is proportional to the amount of intake air Qa, the predetermined period set after the transient operation is set to a period until the integral or accumulated amount of air after the transient operation reaches a predetermined value, similar to the case of integral calculation.

Further, as stated above, the predetermined value of the integrated amount of air after the fuel cut operation is set to adapt to a fresh catalyst (i.e., the integrated amount of air until the amount of oxygen storage of the catalyst 12 is restored becomes maximum) in order to ensure convergence ability for all catalysts 12 ranging from a new catalyst to a degraded catalyst.

Reverting to FIG. 2, following step 710, the upstream target air fuel ratio AFobj is calculated by totaling or adding up the initial value AF0 and the second PI calculation values AFP2, AFI2, as shown in the following expression (32) (step 711).

$$AFobj=AF0+AFP2+AFI2 \quad (32)$$

In expression (32) above, the initial value AF0 is a value (e.g., around 14.53) which is set for each operating condition to correspond to the stoichiometric air fuel ratio, as stated before.

Subsequently, bound pair limiting processing is performed on the upstream target air fuel ratio AFobj, as shown in the following expression (33) (step 712).

$$AFmin<AFobj<AFmax \quad (33)$$

By performing the bound pair limiting processing as shown in expression (33) above, an excessively large air fuel operation can be prevented, thereby making it possible to prevent deterioration in drivability, etc.

In addition, the upper and lower limit values AFmax, AFmin may be set for each engine operating condition, as a result of which it is possible to cope with constraints on drivability that change depending on engine operating conditions.

Here, note that even if the upper and lower limit values AFmax, AFmin are changed, gain settings are not influenced, and hence no influence is given to the stability of the air fuel ratio feedback control.

Then, the second air fuel ratio feedback control section 150 makes a determination as to whether a forced variation condition for forcedly varying the upstream target air fuel ratio AFobj holds (step 713). As the forced variation condition, there are enumerated the following ones: during the degradation diagnose of the catalyst 12, during the improvement of the purification characteristic of the catalyst 12, during the failure diagnosis of the downstream oxygen sensor 15, etc.

When it is determined in step 713 that the forced variation condition does not hold (that is, No), the control routine of FIG. 7 is terminated at once without executing forced variation processing on the upstream target air fuel ratio AFobj.

On the other hand, when it is determined in step 713 that the forced variation condition holds (that is, Yes), a forced variation with a variation amplitude or width ΔAFpt is applied to the upstream target air fuel ratio AFobj (step 714), as shown in the following expression (34), and the control routine of FIG. 7 is terminated.

$$AFobj=AFobj+\Delta AFpt \quad (34)$$

In expression (34) above, the variable amplitude ΔAFpt is set to a predetermined absolute value (predetermined positive or negative value), and it is switched over between a positive value (e.g., +0.25) and a negative value (e.g., −0.25) at a predetermined period.

Figure 10:
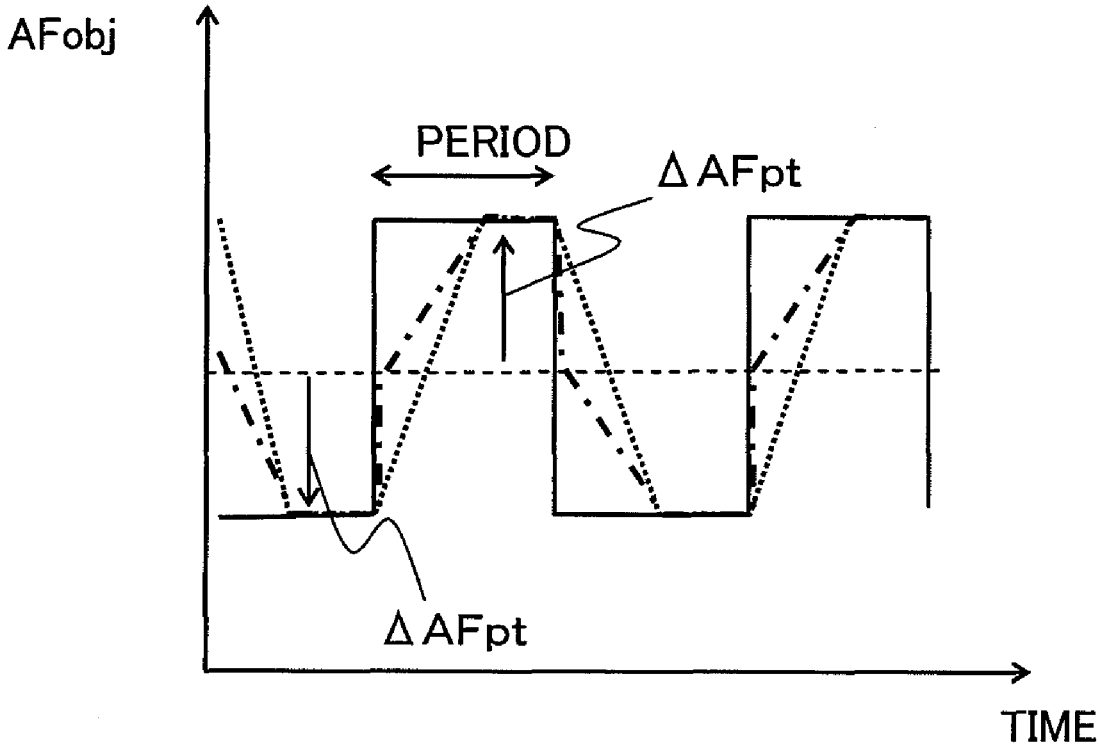
FIG. 10 is a timing chart illustrating the change over time of an upstream target air fuel ratio which is forced to change according to the first embodiment of the present invention.

FIG. 10 is a timing chart illustrating the change over time of the upstream target air fuel ratio AFobj which is forced to change.

In FIG. 10, a solid line, a broken line and an alternate long and short dash line indicate examples of different variation waveforms, respectively, wherein the upstream target air fuel ratio AFobj is forced to vary by the variable amplitude ΔAFpt from a central value (see a dotted line) at the predetermined period.

As shown in FIG. 10, the upstream target air fuel ratio AFobj, if has a predetermined variation amplitude ΔAFpt and a predetermined period, may be controlled by a variation waveform that changes in a stepwise manner (see the solid line), or it may be controlled by other arbitrary variation waveforms (see the broken line and the alternate long and short dash line).

The variation amplitude ΔAFpt and the period are set for each operating condition by taking account of various purposes such as the degradation diagnosis of the catalyst 12, improvements in the purification characteristic of the catalyst 12, etc.

In addition, the second proportional gain Kp2 and the second integral gain Ki2 may be changed when the forced variation condition of the upstream target air fuel ratio AFobj holds.

In this case, the second proportional gain Kp2 is set so as not to be changed by the flow rate of the exhaust gas qa, and the second integral gain Ki2 is set so as to be proportional to the flow rate of the exhaust gas qa. With this, it is possible to cope with other requirements without impairing the stability of air fuel ratio feedback control.

For example, in the degradation diagnosis of the catalyst 12, the degradation diagnosis is carried out from the magnitude of the variation of the output value V2 of the downstream oxygen sensor 15, so if the variation of the output value V2 is suppressed to an excessive extent by the air fuel ratio feedback control, the degradation detectability of the catalyst 12 is reduced.

Accordingly, by setting the second proportional gain Kp2 or the second integral gain Ki2 smaller than an ordinary gain set value, controllability on the variation of the output value V2 can be reduced, and at the same time control stability can be maintained, thereby making it possible to improve the degradation detectability of the catalyst 12.

Figure 11:
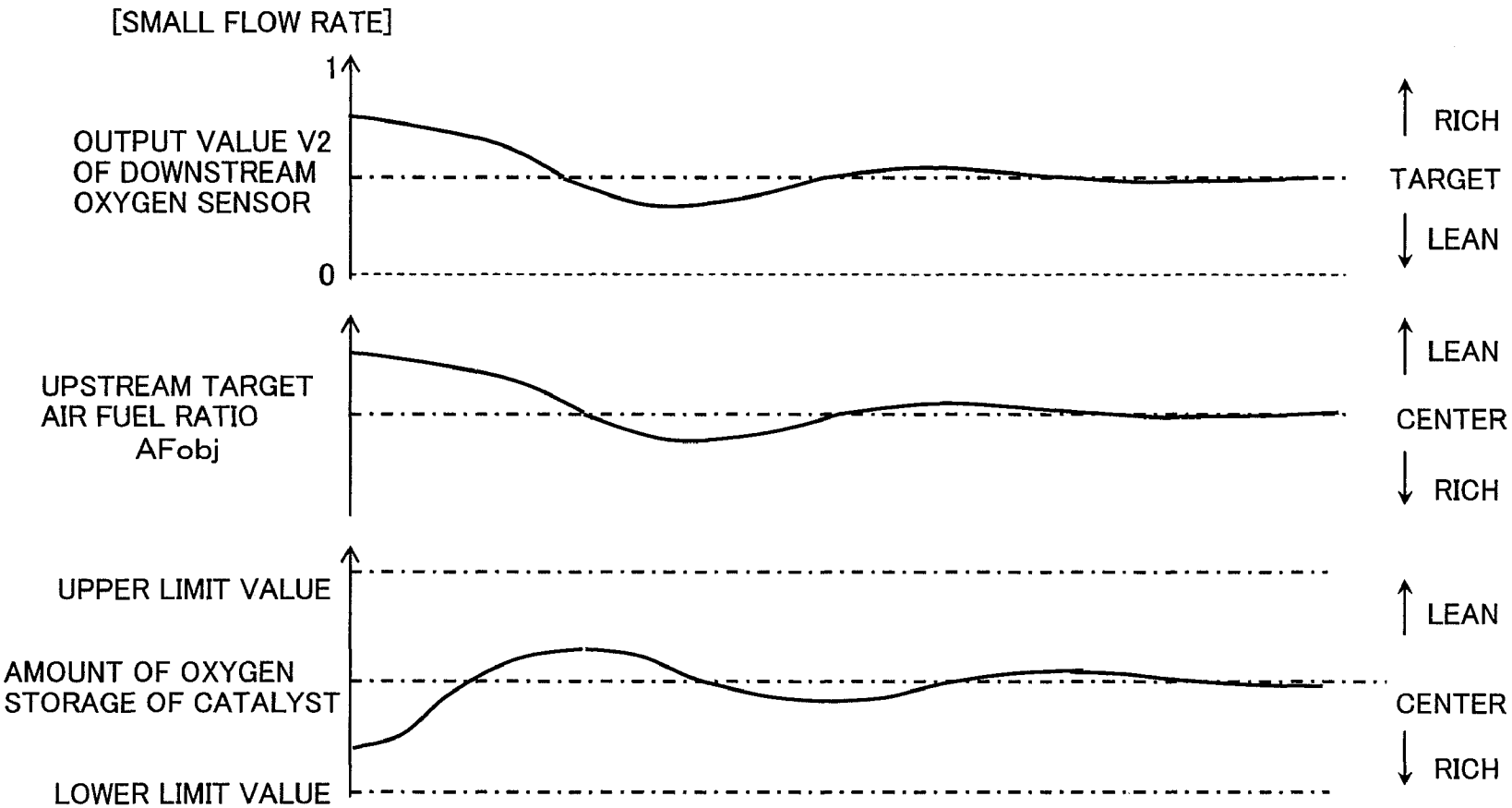
FIG. 11 is a timing chart explaining a second air fuel ratio feedback control behavior when the flow rate of an exhaust gas is in a small level according to the first embodiment of the present invention.
Figure 12:
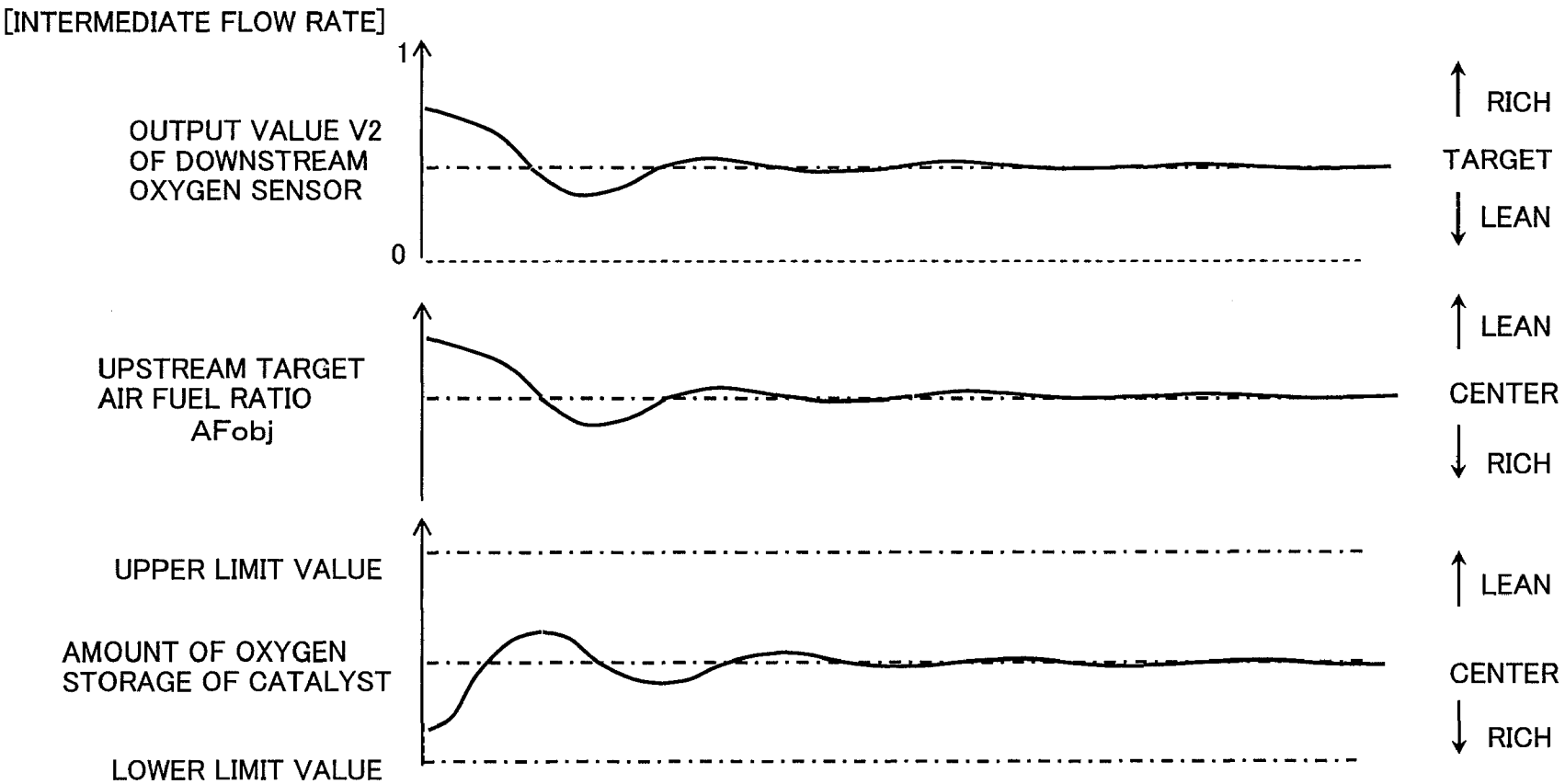
FIG. 12 is a timing chart explaining a second air fuel ratio feedback control behavior when the flow rate of an exhaust gas is in an intermediate level according to the first embodiment of the present invention.
Figure 13:
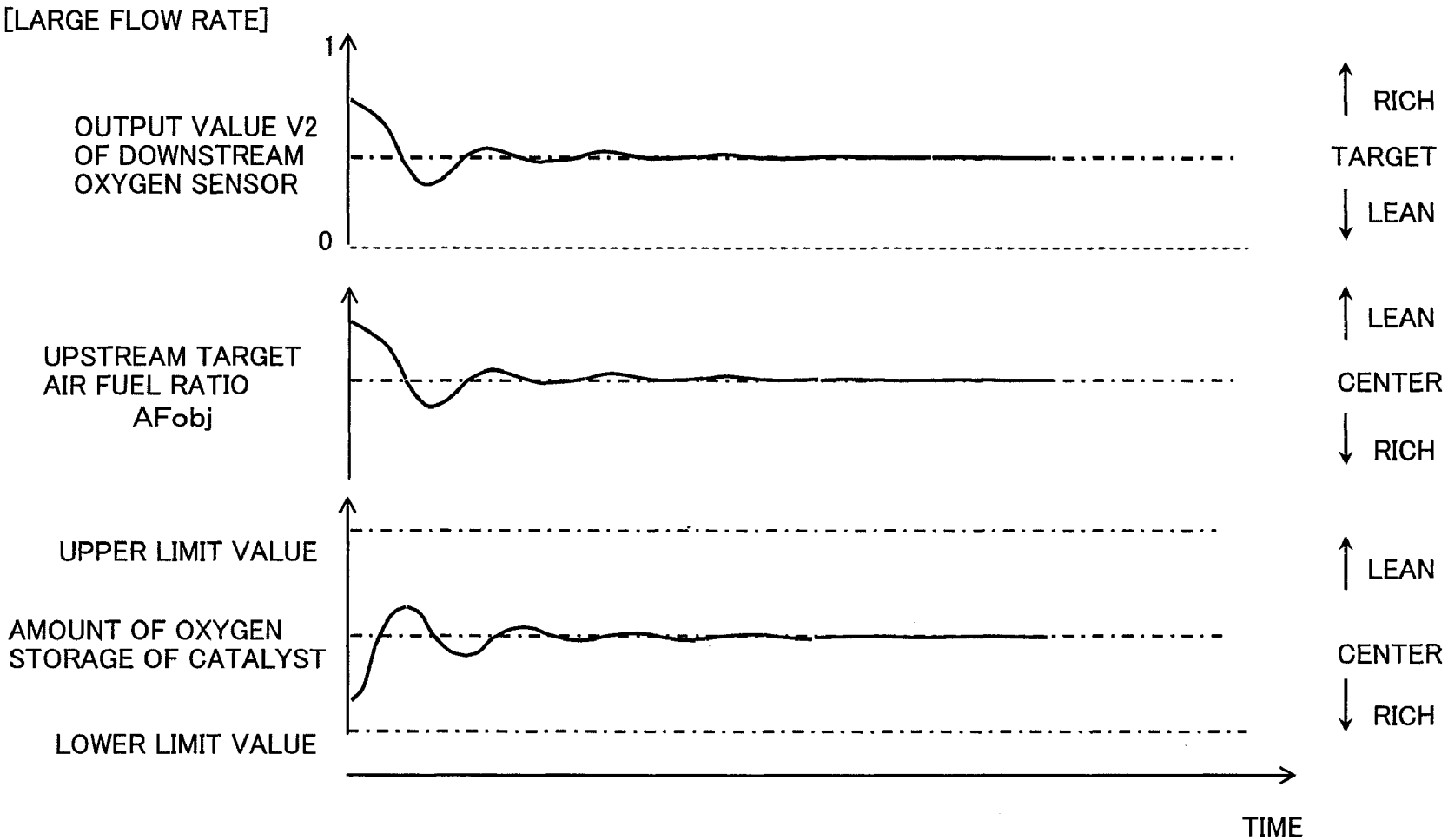
FIG. 13 is a timing chart explaining a second air fuel ratio feedback control behavior when the flow rate of an exhaust gas is in a large level according to the first embodiment of the present invention.

FIG. 11 through FIG. 13 are timing charts that show control operations based on the second air fuel ratio feedback control section 150, wherein the individual behaviors of the output value V2 of the downstream oxygen sensor 15 after occurrence of an external disturbance, the upstream target air fuel ratio AFobj, and the amount of oxygen storage of the catalyst 12 are shown when the flow rate of the exhaust gas qa is a small level, an intermediate level, and a large level, respectively.

As described above, the second proportional gain Kp2 is set so as not to be changed with respect to the change in the flow rate of the exhaust gas qa, whereas the second integral gain Ki2 is set so as to change in proportion to the flow rate of the exhaust gas qa.

Accordingly, as shown in FIG. 11 through FIG. 13, the individual transient waveforms until a target value is reached by convergence are not changed depending on the difference of the flow rate of the exhaust gas qa, with only the change rate thereof (the length in the time direction on the axis of abscissa) being changed.

In other words, it is found that the stability of the air fuel ratio control according to the second air fuel ratio feedback control section 150 is not changed depending on the difference of the flow rate of the exhaust gas qa, but a convergence time to the target value (the change rate of each transient waveform) becomes shorter (the time direction length becomes shorter) as the flow rate of the exhaust gas qa increases, and it changes proportional to the flow rate of the exhaust gas qa.

As described above, the air fuel ratio control apparatus for an internal combustion engine according to the first embodiment of the present invention includes the catalyst 12 that is installed in the exhaust manifold 11 or the exhaust pipe 14 (exhaust system) of the engine (internal combustion engine) 1 for purifying the exhaust gas from the engine 1, the upstream oxygen sensor 13 (upstream air fuel ratio sensor) that is arranged at a location upstream of the catalyst 12 for detecting the air fuel ratio in the upstream exhaust gas, the downstream oxygen sensor 15 (downstream air fuel ratio sensor) that is arranged at a location downstream of the catalyst 12 for detecting the air fuel ratio in the downstream exhaust gas, the first air fuel ratio feedback control section 130, and the second air fuel ratio feedback control section 150.

The first air fuel ratio feedback control section 130 adjusts the amount of fuel supplied to the engine 1 in accordance with the air fuel ratio detected by the upstream oxygen sensor 13 and the upstream target air fuel ratio AFobj (e.g., an air fuel ratio deviation therebetween) in such manner that the air fuel ratio in the upstream exhaust gas and the upstream target air fuel ratio AFobj are made to coincide with each other.

The second air fuel ratio feedback control section 150 operates, by using at least proportional calculation and integral calculation, the upstream target air fuel ratio in accordance with the air fuel ratio deviation between the detected air fuel ratio of the downstream oxygen sensor and the downstream target air fuel ratio so as to make the detected air fuel ratio of the downstream oxygen sensor 15 and the downstream target air fuel ratio coincide with each other.

In addition, the second air fuel ratio feedback control section 150 sets the integral gain of the integral calculation (the second integral gain Ki2) to be larger or the update period ΔT of the integral calculation to be smaller in accordance with the increasing flow rate of the exhaust gas qa, so that the change rate of the integral calculation with respect to the air fuel ratio deviation is increased. Also, the second air fuel ratio feedback control section 150 sets the proportional gain of the proportional calculation (the second proportional gain Kp2) so as not to be changed with respect to the change in the flow rate of the exhaust gas qa.

As a result, it is possible to set the proportional gain and the integral gain (the second proportional gain Kp2 and the second integral gain Ki2) appropriate for the delay in the oxygen storage operation of the catalyst 12, whereby the stability of the air fuel ratio feedback control can be raised, and the deterioration of the exhaust gas can be prevented.

Embodiment 2

Although in the above-mentioned first embodiment, a linear type oxygen sensor having a linear output characteristic with respect to a change in the air fuel ratio is used as the upstream oxygen sensor 13, there may be used a λ type oxygen sensor having a binary output characteristic in which its output rapidly changes in the vicinity of the stoichiometric air fuel ratio.

Figure 14:
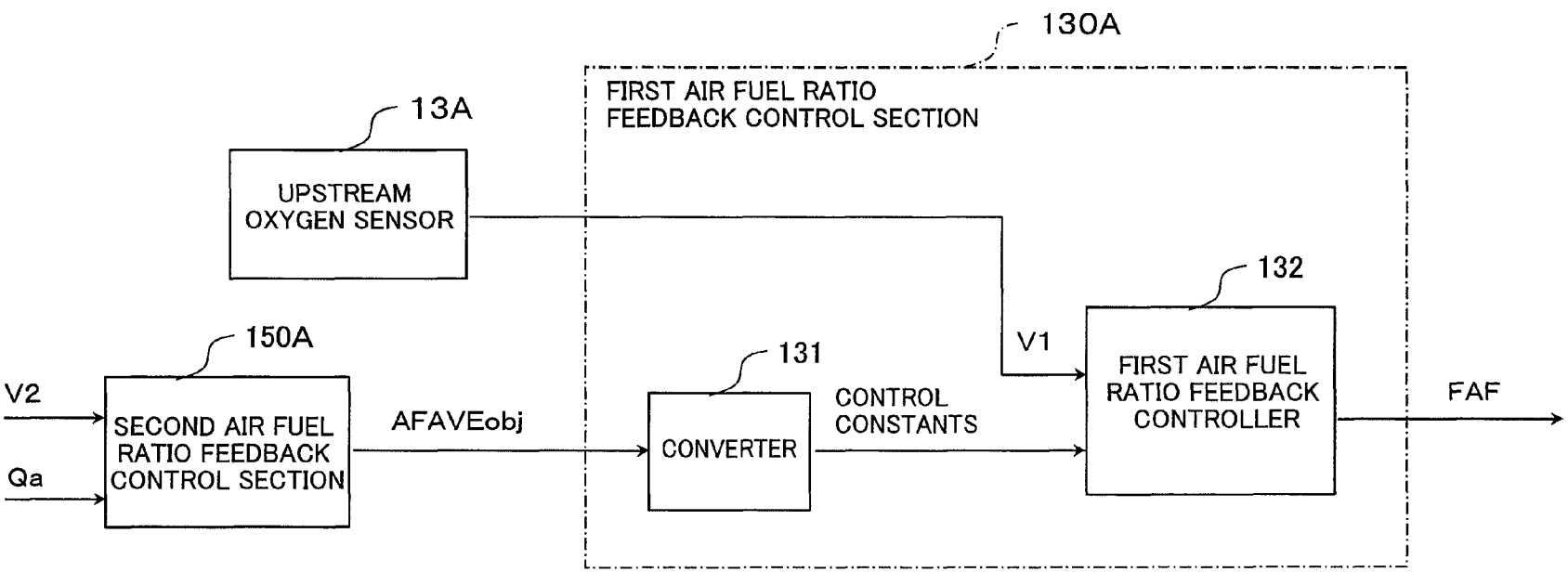
FIG. 14 is a functional block diagram showing the construction of essential portions of an air fuel ratio control apparatus for an internal combustion engine according to a second embodiment of the present invention.

FIG. 14 is a functional block diagram that shows essential portions of an air fuel ratio control apparatus for an internal combustion engine according to a second embodiment of the present invention, wherein an illustration of the construction thereof similar to that in the above-mentioned first embodiment (see FIGS. 1 and 2) is omitted and those elements corresponding to the above-mentioned ones are identified by the same symbols with "A" attached to their ends.

In FIG. 14, an upstream oxygen sensor 13A is constituted by a λ type oxygen sensor, and inputs an output value V1 to a first air fuel ratio feedback control section 130A.

Also, a second air fuel ratio feedback control section 150A calculates an upstream average target air fuel ratio AFAVEobj by averaging an upstream target air fuel ratio AFobj and inputs it to the first air fuel ratio feedback control section 130A.

The first air fuel ratio feedback control section 130A includes a converter 131 that sets a control constant (to be described later) in accordance with the upstream target average air fuel ratio AFAVEobj, and a first air fuel ratio feedback controller 132 that calculates a fuel correction factor FAF based on the output value V1 and the control constant.

In case where the upstream oxygen sensor 13 comprising a linear type oxygen sensor is used as in the above-mentioned first embodiment (FIG. 1), an actual upstream air fuel ratio can be detected, so a feedback control system is designed in which the upstream target air fuel ratio AFobj and the actual air fuel ratio (detected value) coincide with each other.

However, in case where the upstream oxygen sensor 13A comprising a λ type oxygen sensor is used as shown in FIG. 14, only binary information consisting of a rich air fuel ratio and a lean air fuel ratio can be detected, so a control system is designed which performs air fuel ratio feedback control while fluctuating or varying as the upstream air fuel ratio to a rich side and a lean side in a periodic manner, whereby the average air fuel ratio (the average value of the air fuel ratio oscillating in a periodic manner) is controlled in accordance with the upstream target average air fuel ratio AFAVEobj.

Accordingly, the second air fuel ratio feedback control section 150A calculates the upstream average target air fuel ratio AFAVEobj in place of the above-mentioned upstream target air fuel ratio AFobj, and the first air fuel ratio feedback control section 130A is provided with a converter 131 that calculates the control constant for the first air fuel ratio feedback control in accordance with the upstream target average air fuel ratio AFAVEobj in order to improve the control precision of the upstream average air fuel ratio.

Here, note that the second air fuel ratio feedback control section 150A is the same as the above-mentioned one 150 excluding that the upstream target average air fuel ratio AFAVEobj is calculated in place of the upstream target air fuel ratio AFobj.

The oscillation of the air fuel ratio is averaged and turned into a minute oscillation of the amount of oxygen storage by means of the oxygen storage operation of the catalyst 12. Accordingly, a large behavior of the amount of oxygen storage is correlated to the behavior of the average air fuel ratio.

Figure 15:
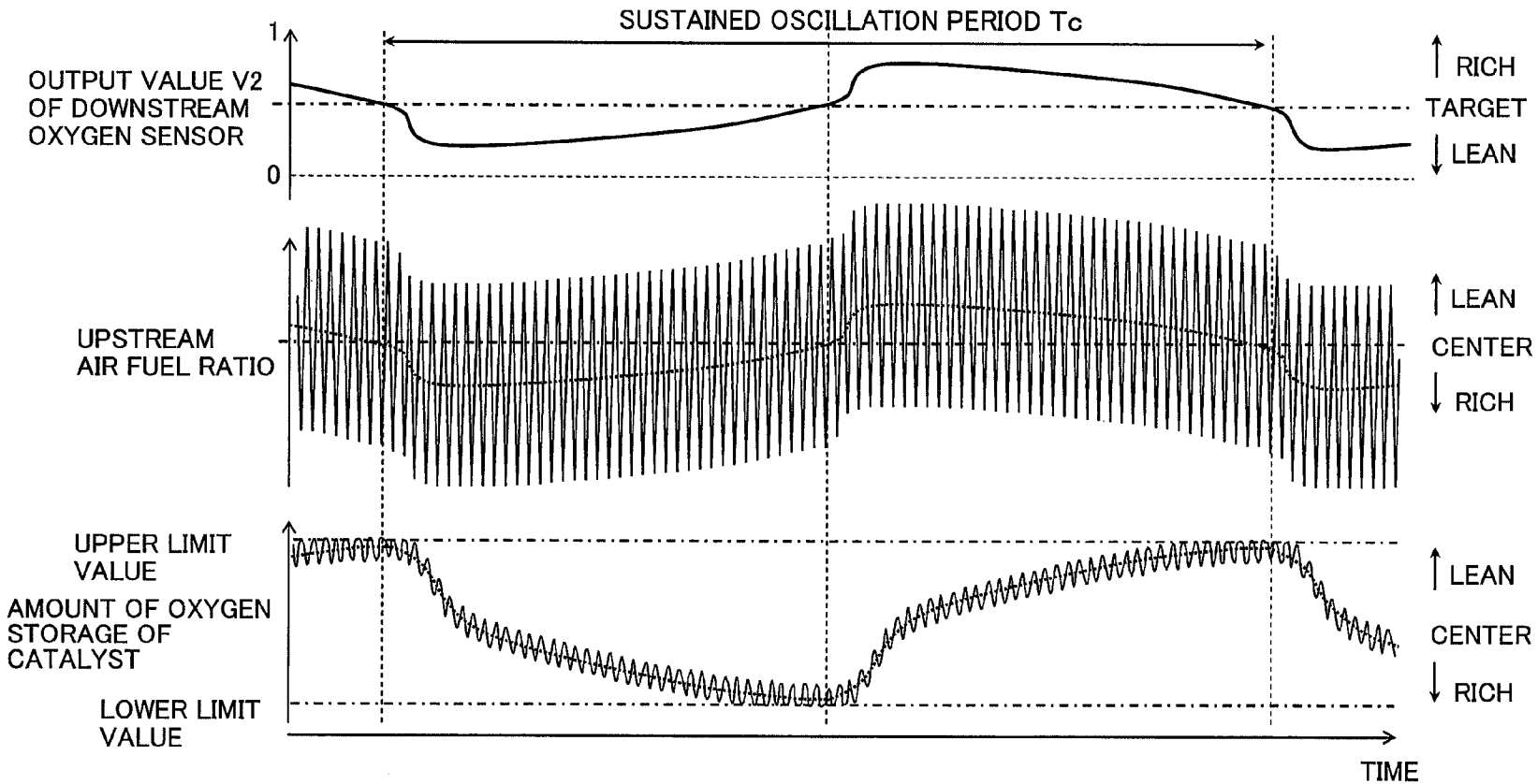
FIG. 15 is a timing chart explaining control behavior according to the second embodiment of the present invention.

FIG. 15 is a timing chart that shows the behavior of the second embodiment of the present invention, wherein the change over time of the output value V2 of the downstream oxygen sensor 15, the upstream air fuel ratio, and the amount of oxygen storage of the catalyst 12 are illustrated in association with one another.

As shown in FIG. 15, what is correlated to the behavior of the amount of oxygen storage at the time of the stability limit is the amount of operation of the upstream average air fuel ratio due to the downstream oxygen sensor 15 (see a dotted line waveform).

Accordingly, in the target average air fuel ratio of operation according to the second embodiment of the present invention, the behaviors of the proportional gain at the limit of stability and the sustained oscillation period exhibit substantially the same tendency as that in the case of the target air fuel ratio operation according to the above-mentioned first embodiment.

Accordingly, in the second embodiment of the present invention, too, the second proportional gain Kp2 is set so as not to be changed with respect to a change b in the flow rate of the exhaust gas qa, whereas the second integral gain Ki2 is set to be proportional to the flow rate of the exhaust gas qa. With this, it is possible to keep the stability of the air fuel ratio feedback control adequately.

In addition, the first feedback control section 130A includes the converter 131 that calculates an amount of operation of the control constant based on the upstream target average air fuel ratio AFAVEobj so as to improve the control precision of the upstream average air fuel ratio, and the first air fuel ratio feedback controller 132 that performs air fuel ratio feedback control based on the output value V1 of the upstream oxygen sensor 13A and the control constant.

Moreover, as will be described later, in order to operate or manipulate the upstream average air fuel ratio in accordance with the output value V2 of the downstream oxygen sensor 15, as disclosed for example in the above-mentioned first patent document (Japanese patent application laid-open No. S63-195351), there is used a system that variably sets the control constant in accordance with the output value V2 of the downstream oxygen sensor 15 by using skip amounts RSR, RSL, integration constants KIR, KIL, delay times TDR, TDL or a comparison voltage VR1 for the output value V1 of the upstream oxygen sensor 13A as the control constant for the first air fuel ratio feedback control.

Here, note that the control constant includes values for any two or more of parameters among the delay times TDR, TDL, the skip amounts RSR, RSL, integral gains (integral constants KIR, KIL), and the comparison voltage VR1.

For example, when the rich skip amount RSR for correction to a rich side is set large, the average air fuel ratio shifts to the rich side, and even when the lean skip amount RSL for correction to a lean side is set small, the average air fuel ratio also shifts to the rich side.

On the contrary, when the lean skip amount RSL is set large, the average air fuel ratio shifts to the lean side, and even when the rich skip amount RSR is set small, the average air fuel ratio also shifts to the lean side.

Accordingly, the average air fuel ratio can be controlled by correcting the rich skip amount RSR and the lean skip amount RSL in accordance with the output value V2 of the downstream oxygen sensor 15.

In addition, when the rich integral constant KIR for correction to the rich side is set large, the average air fuel ratio shifts to the rich side, and even when the lean integral constant KIL for correction to the lean side is set small, the average air fuel ratio also shifts to the rich side.

On the contrary, when the lean integral constant KIL is set large, the average air fuel ratio shifts to the lean side, and even when the rich integral constant KIR is set small, the average air fuel ratio also shifts to the lean side.

Accordingly, the average air fuel ratio can be controlled by correcting the rich integral constant KIR and the lean integral constant KIL in accordance with the output value V2 of the downstream oxygen sensor 15.

Moreover, regarding the rich and lean delay times, the average air fuel ratio shifts to the rich side when set as the rich delay time (TDR)>the lean delay time (−TDL), and on the contrary, the average air fuel ratio shifts to the lean side when set as the lean delay time (−TDL)>the rich delay time (TDR).

Accordingly, the average air fuel ratio can be controlled by correcting the rich and lean delay times TDR, TDL in accordance with the output value V2 of the downstream oxygen sensor 15.

Further, when the comparison voltage VR1 for the output value V1 is set large, the average air fuel ratio shifts to the rich side, whereas when the comparison voltage VR1 of the output value V1 is set small, the average air fuel ratio is shifted to the lean side.

Accordingly, the average air fuel ratio can be controlled by correcting the comparison voltage VR1 for the output value V1 in accordance with the output value V2 of the downstream oxygen sensor 15.

Thus, the upstream average air fuel ratio can be controlled by correcting the above-mentioned control constants in accordance with the output value V2 of the downstream oxygen sensor 15.

Also, it is possible to improve the controllability of the average air fuel ratio by manipulating or operating two or more of the delay times, the skip amounts, the integral gains, and the comparison voltage as control constants at the same time.

In addition, in order to raise the control precision of the average air fuel ratio by operating the control constants, and in order to make positive use of the degree of freedom due to operating two or more of the control constants, it is considered that the operation of the control constants is managed by the average air fuel ratio.

In this case, as shown in FIG. 14, there are used the second air fuel ratio feedback control section 150A that calculates the upstream target average air fuel ratio AFAVEobj based on the output value V2 of the downstream oxygen sensor 15, and the converter 131 that calculates the amount of operation of the control constants from the upstream target average air fuel ratio AFAVEobj.

Since the relation between the amount of operation of the control constants and the amount of operation of the upstream average air fuel ratio is nonlinear, as is well known, in conventional apparatuses, the rich/lean operational direction of the average air fuel ratio is able to be managed, but the amount of operation of the control constants are not able to be accurately managed. Further, if two or more control constants are operated, a nonlinear interaction will occur, so in the conventional apparatuses, there is a problem that it is further difficult to accurately manage the amount of operation of the average air fuel ratio, and that the stability and control behavior of the second air fuel ratio feedback control are varied.

However, according to the second embodiment of the present invention, the upstream average air fuel ratio can be accurately controlled by setting the control constants in accordance with a management index of the upstream target average air fuel ratio AFAVEobj, and the stability of the second air fuel ratio feedback control can be managed in accordance with the individual magnitudes of the proportional gain and the integral gain to operate the upstream average air fuel ratio according to the second air fuel ratio feedback control.

Although in controlling the average air fuel ratio according to each control constant, there are advantages and disadvantages (e.g., the control precision, the width or range of operation, or the control period of the average air fuel ratio, the oscillation width or amplitude of the air fuel ratio, etc.), it is possible to make the best use of the individual advantages by specifically setting the individual control constants in accordance with the operating point of the upstream target average air fuel ratio AFAVEobj.

Now, specific reference will be made to the operation of the second embodiment of the present invention as illustrated in FIG. 14 while referring to a flow chart of FIG. 16.

Figure 16:
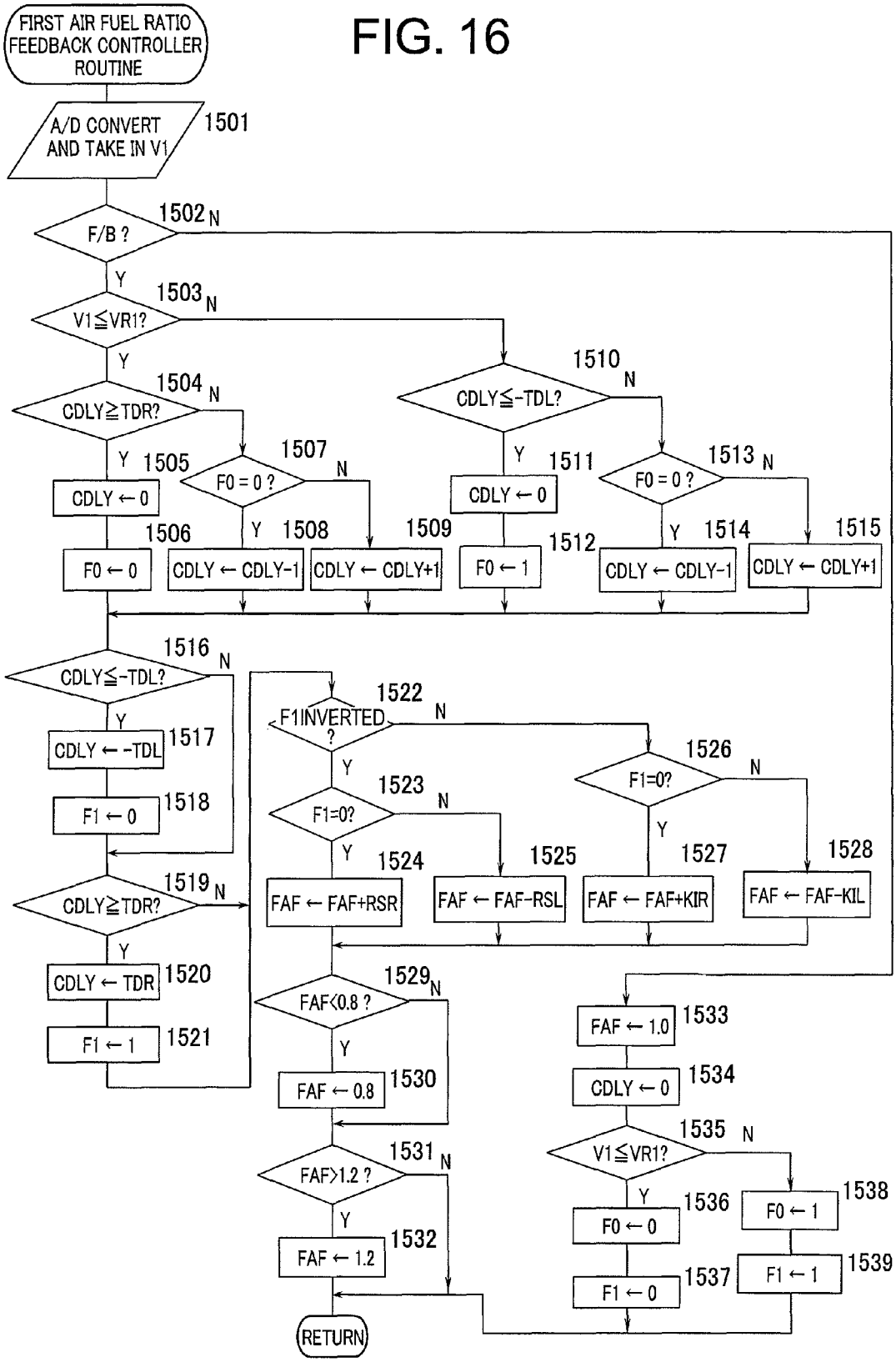
FIG. 16 is a flow chart illustrating a first air fuel ratio feedback control operation according to the second embodiment of the present invention.

FIG. 16 shows a processing routine for the first air fuel ratio feedback controller 132, wherein an operation is illustrated which controls the upstream average air fuel ratio by calculating the air fuel ratio correction factor FAF based on the output value V1 of the upstream oxygen sensor 13A and a control constant for the first air fuel ratio feedback control which is changed in accordance with the upstream target average air fuel ratio AFAVEobj. The processing routine of FIG. 16 is executed at every predetermined time (e.g., 5 msec).

In FIG. 16, the first air fuel ratio feedback controller 132 first A/D converts and takes in the output value V1 of the upstream oxygen sensor 13A(step 1501), and determines whether a closed-loop (feedback) condition for the air fuel ratio by the upstream oxygen sensor 13 holds (step 1502).

For example, in case where an air fuel ratio control condition other than stoichiometric air fuel ratio control (e.g., during engine starting, during fuel enriching control at low water temperatures, during fuel enriching control for increasing power under a high load, during fuel leaning control for improvements in fuel consumption or mileage, during fuel leaning control after engine starting, or during fuel cut operation) holds, or in case where the upstream oxygen sensor 13A is in an inactive state or in a failed state, it is determined, in either case, that a closed-loop condition does not hold, whereas in the other cases, it is determined that a closed-loop condition holds.

When it is determined in step 1502 that the closed-loop condition does not hold (that is, No), the air fuel ratio correction factor FAF is set to "1.0" (step 1533). In this case, the air fuel correction factor FAF may be a value immediately before the termination of the closed-loop control or a learnt value (a storage value in a backup RAM 106 in a control circuit 10).

In addition, following step 1533, a delay counter CDLY is reset to "0" (step 1534), and it is determined whether the output value V1 of the upstream oxygen sensor 13A is less than or equal to the comparison voltage VR1 (the air fuel ratio is in a lean state) (step 1535).

When in step 1535, the air fuel ratio indicates a lean state and it is determined as V1≦VR1 (that is, Yes), a pre-delay air fuel ratio flag F0 is set to "0 (lean)" (step 1536), and a post-delay air fuel ratio flag F1 is set to "0 (lean)" (step 1537), after which the processing routine of FIG. 16 is terminated, and a return is performed.

On the other hand, when in step 1535, the air fuel ratio indicates a rich state and it is determined as V1>VR1 (that is, No), the pre-delay air fuel ratio flag F0 is set to "1 (rich)" (step 1538), and the post-delay air fuel ratio flag F1 is set to "1 (rich)" (step 1539), after which the processing routine of FIG. 16 is terminated.

In steps 1534 through 1539, an initial value when the closed-loop condition subsequently holds is set.

On the other hand, when it is determined in step 1502 that the closed-loop condition holds (that is, Yes), it is determined, depending on whether the output value V1 of the upstream oxygen sensor 13A is less than or equal to the comparison voltage VR1 (e.g., 0.45 V), whether the air fuel ratio is leaner or richer with respect to the comparison voltage VR1, similar to the above step 1533 (step 1503).

When in step S1503 the air fuel ratio indicates a lean state and it is determined as V1≦VR1 (that is, Yes), and subsequently, it is determined whether the delay counter CDLY is larger than or equal to a maximum value TDR (step 1504).

When it is determined as CDLY≧TDR in step 1504 (that is, Yes), the delay counter CDLY is set to "0" (step 1505), and the pre-delay air fuel ratio flag F0 is set to "0 (lean)" (step 1506), after which the control flow proceeds to the following determination processing (step 1516).

On the other hand, when it is determined as CDLY<TDR in step S1504 (that is, No), it is subsequently determined whether the pre-delay air fuel ratio flag F0 is "0 (lean)" (step 1507).

When it is determined as F0=0 in step 1507 (that is, Yes), the delay counter CDLY is subtracted by "1" (step 1508), and the control flow proceeds to step 1516, whereas when it is determined as F0=1 in step 1507 (that is, No), the delay counter CDLY is added by "1" (step 1509), and the control flow proceeds to step 1516.

On the other hand, when in step 1503 the air fuel ratio indicates a rich state and it is determined as V1>VR1 (that is, No), it is subsequently determined whether the delay counter CDLY is less than or equal to a minimum value (−TDL) (step 1510).

When it is determined as CDLY≦−TDL in step 1510 (that is, Yes), the delay counter CDLY is set to "0" (step 1511), and the pre-delay air fuel ratio flag F0 is set to "1 (rich)" (step 1512), after which the control flow proceeds to step 1516.

On the other hand, when it is determined as CDLY>−TDL in step S1510 (that is, No), it is subsequently determined whether the pre-delay air fuel ratio flag F0 is "0 (lean)" (step 1513).

When it is determined as F0=0 in step 1513 (that is, Yes), the delay counter CDLY is subtracted by "1" (step 1514), and the control flow proceeds to step 1516, whereas when it is determined as F0=1 in step 1513 (that is, No), the delay counter CDLY is added by "1" (step 1515), and the control flow proceeds to step 1516.

In step 1516, similar to step 1510, it is determined whether the delay counter CDLY is less than or equal to the minimum value (−TDL), and when it is determined as CDLY≦−TDL (that is, Yes), the delay counter CDLY is set to the minimum value (−TDL) (step 1517), and the delay counter CDLY is guarded to a value equal to or more than the minimum value (−TDL).

In addition, when the delay counter CDLY reaches the minimum value (−TDL), the post-delay air fuel ratio flag F1 is set to "0 (lean)" (step 1518), and the control flow then proceeds to determination processing (step 1519).

On the other hand, when it is determined as CDLY>−TDL in step 1516 (that is, No), the control flow proceeds to step 1519 without executing steps 1517, 1518.

Here, note that the minimum value (−TDL) is a lean delay time for which a determination that the upstream air fuel ratio is in a rich state is held even if the output value V1 of the upstream oxygen sensor 13A has changed from the rich state to a lean state, and it is defined as a negative value.

In step 1519, similar to step 1504, it is determined whether the delay counter CDLY is more than or equal to the maximum value TDR, and when it is determined as CDLY≧TDR (that is, Yes), the delay counter CDLY is set to the maximum value (TDR) (step 1520), and the delay counter CDLY is guarded to a value equal to or less than the maximum value (TDR).

In addition, when the delay counter CDLY reaches the maximum value (TDR), the post-delay air fuel ratio flag F1 is set to "1 (rich)" (step 1521), and the control flow then proceeds to determination processing (step 1522).

On the other hand, when it is determined as CDLY<TDR in step 1519 (that is, No), the control flow proceeds to step 1522 without executing steps 1520, 1521.

Here, note that the maximum value (TDR) is a rich delay time for which a determination that the upstream air fuel ratio is in a lean state is held even if the output value V1 of the upstream oxygen sensor 13A has changed from the lean state to a rich state, and it is defined as a positive value.

Hereinafter, in steps 1522 through 1525, skip processing based on the skip amounts RSR, RSL is performed.

First of all, in step 1522, it is determined, depending on whether the sign of the post-delay air fuel ratio flag F1 has been inverted, whether the air fuel ratio after delay processing has been inverted.

When it is determined in step 1522 that the air fuel ratio has been inverted and hence the sign of the post-delay air fuel ratio flag F1 has been inverted (that is, Yes), it is subsequently determined, depending on whether the current value of the post-delay air fuel ratio flag F1 is "0", whether the inversion of the air fuel ratio is a rich to lean inversion or a lean to rich inversion (step 1523).

When in step 1523, a rich to lean inversion is indicated and it is determined as F1=0 (that is, Yes), the air fuel ratio correction factor FAF is increased by the rich skip amount RSR in a stepwise manner (step 1524), and the control flow proceeds to the following determination processing (step 1529).

On the other hand, when in step 1523 a lean to rich inversion is indicated and it is determined as F1=1 (that is, No), the air fuel ratio correction factor FAF is decreased by the lean skip amount RSL in a stepwise manner (step 1525), and the control flow proceeds to step 1529.

On the other hand, when it is determined in step 1522 that the sign of the post-delay air fuel ratio flag F1 has not been inverted (that is, No), the following integral process is performed (steps 1526 through 1528).

First of all, similar to step 1523, it is subsequently determined whether the post-delay air fuel ratio flag F1 is "0" (lean) (step 1526), and when it is determined as F1=0 (lean) (that is, Yes), the air fuel ratio correction factor FAF is increased by the rich integral constant KIR in a stepwise manner (step 1527), and the control flow proceeds to step 1529.

On the other hand, when it is determined as F1=1 (rich) in step 1526 (that is, No), the air fuel ratio correction factor FAF is decreased by the lean integral constant KIL in a stepwise manner (step 1528), and the control flow proceeds to step 1529.

Here, note that the individual integral constants KIR, KIL are set to sufficiently small values in comparison with the individual skip constants RSR, RSL, respectively, and are represented as shown in the following expression (35).

$$\text{KIR (or KIL)} < \text{RSR (or RSL)} \quad (35).$$

The step 1527 is a process to gradually increase the amount of injection fuel in a lean state (F1=0), and the step 1528 is a process to gradually decrease the amount of injection fuel in a rich state (F1=1).

Then, in step 1529, it is determined whether the air fuel ratio correction factor FAF calculated in steps 1522 through 1528 is less than a minimum value (e.g., 0.8), and if it is determined as FAF≧0.8 (that is, No), the control flow proceeds to the following determination processing (step 1531) at once.

On the other hand, when it is determined as FAF<0.8 in step 1529 (that is, Yes), the air fuel ratio correction factor FAF is set to "0.8" (step 1530), and hence the air fuel ratio correction factor FAF is guarded to a value equal to or more than the minimum value "0.8", after which the control flow proceeds to step 1531.

Thereafter, in step 1531, it is determined whether the air fuel ratio correction factor FAF is larger than a maximum value (e.g., 1.2), and when it is determined as FAF≦1.2 (that is, No), the processing routine of FIG. 16 is terminated at once.

On the other hand, when it is determined as FAF>1.2 in step 1531 (that is, Yes), the air fuel ratio correction factor FAF is set to "1.2" (step 1530), so the air fuel ratio correction factor FAF is guarded to a value equal to or less than the maximum value "1.2", and the processing routine of FIG. 16 is terminated.

The value of the air fuel ratio correction factor FAF finally calculated is stored in the RAM 105 in the control circuit 10.

Even when the air fuel ratio correction factor FAF becomes too large or too small for some cause according to the above-mentioned steps 1529 through 1532, the air fuel ratio correction factor FAF is guarded within a range between the minimum value (0.8) and the maximum value (1.2), so it is possible to prevent the air fuel ratio of the engine 1 from becoming overrich or overlean.

Figure 17:
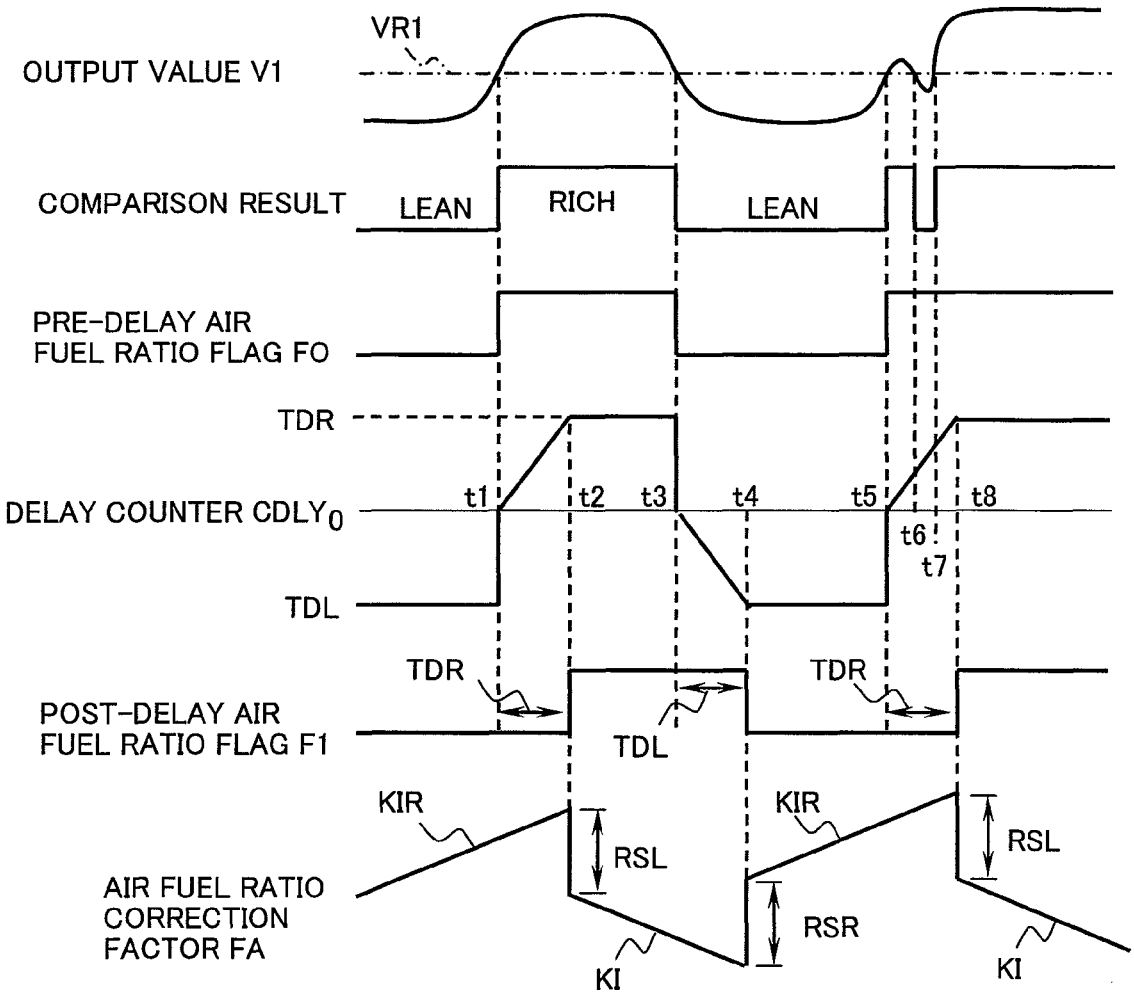
FIG. 17 is a flow chart for supplementarily explaining the first air fuel ratio feedback control operation according to the second embodiment of the present invention.

FIG. 17 is a timing chart for supplementarily explaining the operation of the first air fuel ratio feedback control operation in FIG. 16, wherein the change over time of the output value V1 of the upstream oxygen sensor 13A, the comparison result of a rich/lean determination, the pre-delay air fuel ratio flag F0 (corresponding to the air fuel ratio signal before delay processing), and the delay counter CDLY, the post-delay air fuel ratio flag F1 (corresponding to the delay-processed air fuel ratio signal), and the air fuel ratio correction factor FAF are illustrated in association with one another.

In FIG. 17, each time when an air fuel ratio signal representing the comparison result of a rich/lean determination is obtained based on the output value V1 of the upstream oxygen sensor 13, the pre-delay air fuel ratio flag F0 (air fuel ratio signal before delay processing) is changed into a rich state or a lean state at time points t1, t3 and t5.

In addition, the delay counter CDLY is counted up in the rich state of the pre-delay air fuel ratio flag F0 (the air fuel ratio signal before delay processing)(from time point t1 to time point t2), whereas it is counted down in the lean state thereof (from time point t3 to time point t4). As a result, a post-delay air fuel ratio flag F1 (i.e., a delay-processed air fuel ratio signal) is formed.

For example, even if the air fuel ratio signal inverts from lean to rich at time point t1, the post-delay air fuel ratio flag F1 (delay-processed air fuel ratio signal) is changed into a rich state at time point t2 after having been held lean for the rich delay time TDR.

Thereafter, even if the air fuel ratio signal representing a comparison result changes from rich to lean at time point t3, the post-delay air fuel ratio flag F1 (delay-processed air fuel ratio signal) is changed into a lean state at time point t4 after having been held rich for a lean delay time TDL.

However, even if the air fuel ratio signal representing the comparison result inverts in a period shorter than the rich delay time TDR, as at time points t5, t6 and t7 after the start of rich delay processing, the pre-delay air fuel ratio flag F0 (air fuel ratio signal before delay processing) is never inverted during the delay processing (time points t5 through t8) until the delay counter CDLY reaches the rich delay time TDR.

In other words, the pre-delay air fuel ratio flag F0 (air fuel ratio signal before delay processing) is not influenced by the variation of a temporary comparison result, so it becomes stable as compared with the air fuel ratio signal representing the comparison result.

Accordingly, as shown in FIG. 17, the stable air fuel ratio correction factor FAF can be obtained based on the pre-delay air fuel ratio flag F0 (the air fuel ratio signal before delay processing) stabilized due to delay processing and the post-delay air fuel ratio flag F1 (the air fuel ratio signal after delay processing).

Hereinafter, the amount of fuel Qfuel supplied to the engine 1 is adjusted in accordance with the air fuel ratio correction factor FAF, as shown in the following expression (36), similar to the above-mentioned expression (13).

$$Q\text{fuel1} = Q\text{fuel0} \times FAF \quad (36)$$

As a result, the air fuel ratio of the engine 1 is controlled to a target air fuel ratio.

In expression (36) above, Qfuel0 is a basic fuel amount, and is calculated as shown in the following expression (37) similar to the above-mentioned expression (14).

$$Q\text{fuel0} = Q\text{acyl}/\text{target air fuel ratio} \quad (37)$$

In expression (37) above, Qacyl is the amount of air supplied to the engine proper 1 that is calculated based on an amount of intake air Qa detected by an air flow sensor 3.

The target air fuel ratio is set to an air fuel ratio that is set by a two-dimensional map of the engine rotational speed and the engine load, as shown in FIG. 6.

In case of stoichiometric air fuel ratio control, the target air fuel ratio is set to an upstream target average air fuel ratio AFAVEobj that is calculated by the second air fuel ratio feedback control section 150A, so that the target air fuel ratio thus set is reflected in a feedforward manner.

As a result, a feedback follow-up delay occurring upon a change of the target value can be improved, and the air fuel ratio correction factor FAF can be maintained in the vicinity of its central value of "1.0".

In addition, learning control is performed based on the air fuel ratio correction factor FAF so as to absorb the change over time and the production variation of component elements related to the first air fuel ratio feedback control section 130A, so the precision of the learning control can be improved in accordance with the increasing stability of the air fuel ratio correction factor by feedforward correction.

Moreover, the amount of intake air Qa may be calculated, instead of using the air flow sensor 3, based on an output value of a pressure sensor arranged downstream of a throttle valve in the intake passage 2 and the engine rotational speed, or based on the degree of opening of the throttle valve and the engine rotational speed.

Next, reference will be made to the calculation processing of the converter 131 in the first air fuel ratio feedback control section 130A while referring to a flow chart in FIG. 18.

Figure 18:
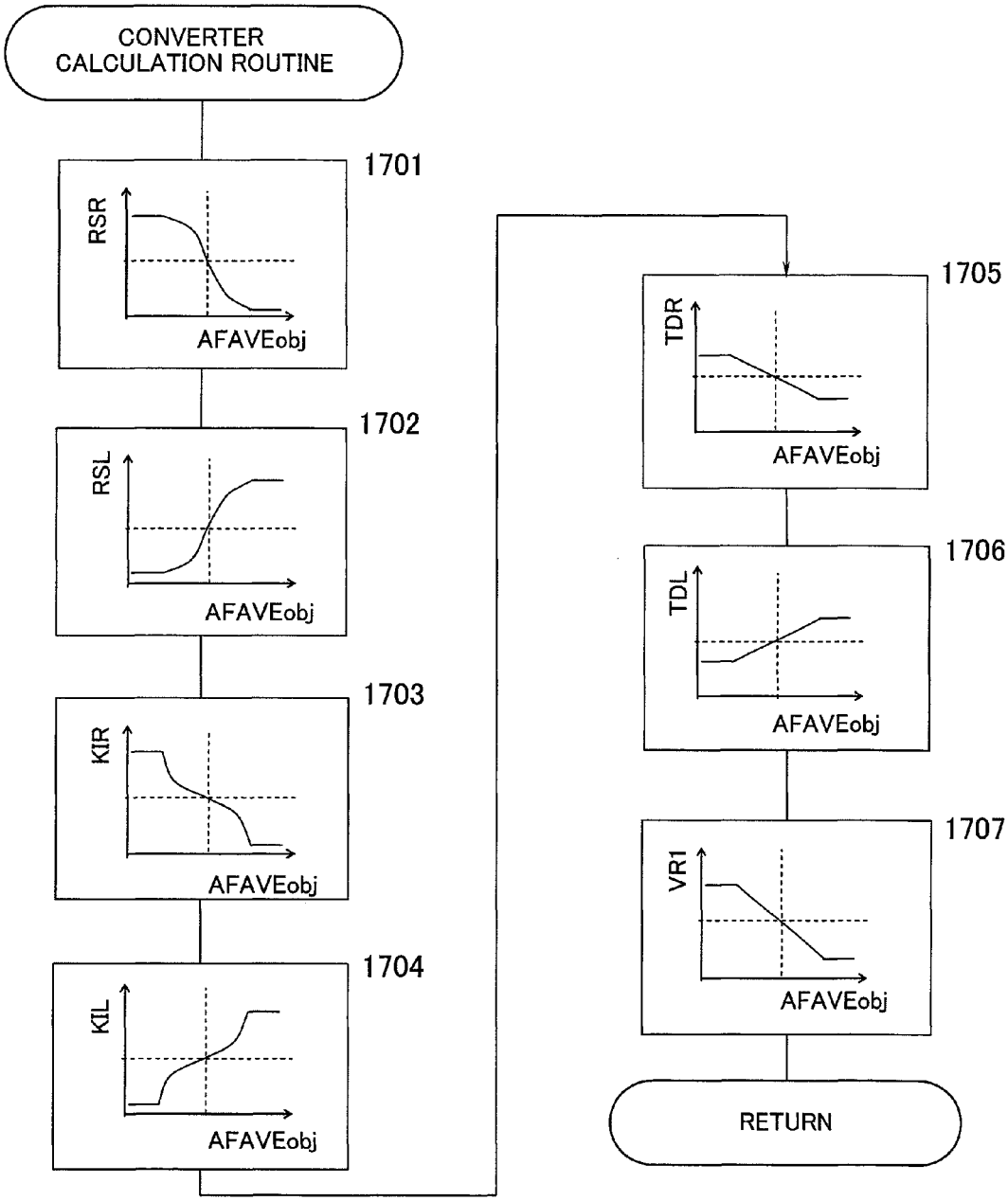
FIG. 18 is a flow chart illustrating a control constant calculation operation according to the second embodiment of the present invention.

The arithmetic calculation routine of the converter 131 in FIG. 18 illustrates a processing procedure for setting control constants (the skip amounts RSR, RSL, the integral constants KIR, KIL, the delay times TDR, TDL, and the comparison voltage VR1) in the first air fuel ratio feedback controller 132 in accordance with the upstream target average air fuel ratio AFAVEobj calculated by the second air fuel ratio feedback control section 150A. The calculation processing routine of FIG. 18 is executed at every predetermined time (e.g., 5 msec).

In FIG. 18, first of all, the converter 131 calculates the rich skip amount RSR by using a one-dimensional map according to the upstream target average air fuel ratio AFAVEobj (step 1701).

At this time, the set value of the skip amount RSR is set beforehand based on theoretical calculations or experiments, as will be described later. In accordance with an input value, a corresponding set value (map search result) is to be output.

In addition, a plurality of one-dimensional maps for the skip amount RSR are provided for each engine operating condition, so that a map search is carried out by switching among the one-dimensional maps in accordance with a change in engine operating conditions. For example, the converter 131 holds a one-dimensional map for each engine operating zone or range divided by a predetermined number of engine revolutions per minute, the engine load, and the cooling water temperature THW.

Moreover, it may not be necessarily a one-dimensional map, but means for uniquely representing the relation between an input value and an output value (e.g., an approximate expression) may instead be used, and in addition, a higher-order map or a higher-order function corresponding to a lot of input values may also be used.

Reverting to FIG. 18, hereinafter, similar to step 1701, the skip amount RSL is calculated in accordance with the upstream target average air fuel ratio AFAVEobj (step 1702). The rich integral constant KIR is calculated in accordance with the upstream target average air fuel ratio AFAVEobj (step 1703), and the lean integral constant KIL is calculated in accordance with the upstream target average air fuel ratio AFAVEobj (step 1704). Also, the rich delay time TDR is calculated in accordance with the target average air fuel ratio AFAVEobj (step 1705), and the lean delay time TDL is calculated in accordance with the target average air fuel ratio AFAVEobj (step 1706). In addition, the comparison voltage VR1 is calculated in accordance with the target average air fuel ratio AFAVEobj (step 1707), and the calculation routine of FIG. 18 is terminated.

As a result, the skip amounts RSR, RSL, the integral constants KIR, KIL, the delay times TDR, TDL, and the comparison voltage VR1 are calculated as control constants corresponding to the upstream target average air fuel ratio AFAVEobj.

As described above, the air fuel ratio control apparatus for an internal combustion engine according to the second embodiment of the present invention includes the upstream air fuel ratio sensor 13A that is arranged at a location upstream of the catalyst 12 for detecting the air fuel ratio in the upstream exhaust gas, the downstream air fuel ratio sensor 15 that is arranged at a location downstream of the catalyst 12 for detecting the air fuel ratio in the downstream exhaust gas, the first air fuel ratio feedback control section 130A and the second air fuel ratio feedback control section 150A.

The first air fuel ratio feedback control section 130A makes the air fuel ratio in the upstream exhaust gas oscillate in the rich and lean directions in a periodic manner, and at the same time, adjusts the amount of fuel supplied to the engine 1 (internal combustion engine) in accordance with the air fuel ratio detected by the upstream air fuel ratio sensor 13A and the upstream target average air fuel ratio AFAVEobj so as to make the average value of the air fuel ratio thus oscillated and the upstream target average air fuel ratio AFAVEobj coincide with each other.

The second air fuel ratio feedback control section 150 operates, by using at least proportional calculation and integral calculation, the upstream target air fuel ratio in accordance with the air fuel ratio deviation between the air fuel ratio detected by the downstream oxygen sensor and the downstream target air fuel ratio so as to make the detected air fuel ratio of the downstream oxygen sensor 15 and the downstream target air fuel ratio coincide with each other.

In addition, the second air fuel ratio feedback control section 150A sets the integral gain of the integral calculation (the second integral gain Ki2) to be larger or the update period ΔT of the integral calculation to be smaller in accordance with the increasing flow rate of the exhaust gas qa, so that the change rate of the integral calculation with respect to the air fuel ratio deviation is increased. Also, the second air fuel ratio feedback control section 150 sets the proportional gain of the proportional calculation (the second proportional gain Kp2) so as not to be changed with respect to the change in the flow rate of the exhaust gas qa.

Moreover, the first air fuel ratio feedback control section 130A sets the control constants of the first air fuel ratio feedback control section 130A in accordance with the upstream target average air fuel ratio AFAVEobj.

Further, the control constants set in accordance with the upstream target average air fuel ratio AFAVEobj include values for any two or more parameters among the delay times, the skip amounts, the integral gains, and the comparison voltage.

The individual set values of the control constants are set beforehand based on theoretical calculations or experimental measurements in such a manner that the actual upstream average air fuel ratio upstream of the catalyst 12 coincides with the upstream target average air fuel ratio AFAVEobj input to the first air fuel ratio feedback control section 130A. In addition, it is possible to set the actual average air fuel ratio so as to coincide with the target air fuel ratio irrespective of the engine operating conditions by changing the set values of the control constants depending on the engine operating conditions.

As described in the above-mentioned first embodiment in association with the above-mentioned expression (17), the amount of operation of the second air fuel ratio feedback control section 130A obtained by the integral calculation is $\Sigma(Ki2 \times \Delta V2)$, but the change rate of the integral calculation with respect to the output deviation ΔV2 is proportional to the flow rate of the exhaust gas qa, so even if the amount of operation by the integral calculation of the second air fuel ratio feedback control section 130A is represented by $Ki2 \times \Sigma(\Delta V2)$, similar advantageous effects can be achieved.

Furthermore, although the upstream oxygen sensor 13A comprising the λ type oxygen sensor is used in the above-mentioned second embodiment, the upstream oxygen sensor 13A may comprise a linear type oxygen sensor. In this case, the average air fuel ratio can be controlled by the use of the first air fuel ratio feedback control section 130A, similar to the one shown in FIG. 14, while making the upstream air fuel ratio oscillate, as a consequence of which the same operational effects as stated above can be achieved.

In addition, in case where the average air fuel ratio is controlled by making the upstream air fuel ratio oscillate by using the upstream oxygen sensor 13A comprising the linear type oxygen sensor, it is possible to perform control with high followability to the target air fuel ratio, so the upstream air fuel ratio may be forced to oscillate by making the target air fuel ratio oscillate in the rich and lean directions in a periodic manner, whereby the average value of the oscillating target air fuel ratio can be controlled based on the downstream oxygen sensor 15, thus providing similar advantageous effects as stated above.

Moreover, the internal combustion engine 1 with one catalyst 12 installed thereon has been described by way of example, but even in an internal combustion engine in which a plurality of catalysts are arranged in series or in parallel to one another with an oxygen sensor being disposed to at a downstream side of each catalyst, it is possible to control an upstream air fuel ratio upstream of each catalyst by using a downstream oxygen sensor arranged at the downstream side of the catalyst, and in this case, too, similar advantageous effects can be achieved.

Further, in case where the downstream oxygen sensor 15 used for air fuel ratio control comprises oxygen sensors located at the downstream side of the plurality of catalysts, respectively, the second proportional gain Kp2 and the second integral gain Ki2 are changed in accordance with the downstream oxygen sensors, wherein the second proportional gain Kp2 is set so as not to be changed with respect to the change in the flow rate of the exhaust gas qa, and the second integral gain Ki2 is set so as to be proportional to the flow rate of the exhaust gas qa. As a result, it is possible to maintain highly stable feedback performance even if the catalyst to be controlled is changed, thus providing similar advantageous effects.

Further, although the target value for air fuel ratio feedback control has been described as a target air fuel ratio, the present invention can be applied to a control system that uses, instead of an air fuel ratio, an arbitrary parameter having a correlation with the air fuel ratio (e.g., an excess air ratio, a voltage, etc.). In this case, similar advantageous effects can be achieved by setting the second integral gain proportional to the flow rate of the exhaust gas qa without changing the second proportional gain for the second air fuel ratio feedback control with respect to the change in the flow rate of the exhaust gas qa in the first or second air fuel ratio feedback control.

In addition, if the downstream oxygen sensor 15 is a sensor that can detect the purification state of the upstream catalyst 12, it is possible to control the purification state of the catalyst 12 by using, as such a sensor, any of a linear air fuel ratio sensor, a NOx sensor, an HC sensor, a CO sensor, and so on, while providing the same operational effects as stated above.

Further, the integral gain of the integral calculation (the second integral gain Ki2) for the feedback control according to the second air fuel ratio feedback control section using the downstream oxygen sensor 15 is set so as to be proportional to the flow rate of the exhaust gas qa, and the proportional gain of the proportional calculation (the second proportional gain Kp2) is set so as not to be changed with respect to the change in the flow rate of the exhaust gas qa, whereby control behavior with high stability and response, being appropriate for the delay in the oxygen storage operation of the catalyst 12, can be achieved, and the state of purification of the catalyst 12 can always be kept adequately.

While the invention has been described in terms of preferred embodiments, those skilled in the art will recognize that the invention can be practiced with modifications within the spirit and scope of the appended claims.

What is claimed is:

1. An air fuel ratio control apparatus for an internal combustion engine characterized by comprising:

a catalyst that is arranged in an exhaust system of an internal combustion engine for purifying an exhaust gas from said internal combustion engine;

an upstream air fuel ratio sensor that is arranged at a location upstream of said catalyst for detecting an air fuel ratio in an upstream exhaust gas upstream of said catalyst;

a downstream air fuel ratio sensor that is arranged at a location downstream of said catalyst for detecting an air fuel ratio in a downstream exhaust gas downstream of said catalyst;

a first air fuel ratio feedback control section that adjusts an amount of fuel supplied to said internal combustion engine in accordance with the air fuel ratio detected by said upstream air fuel ratio sensor and an upstream target air fuel ratio so as to make said air fuel ratio in said upstream exhaust gas and said upstream target air fuel ratio coincide with each other; and a second air fuel ratio feedback control section that operates, by using at least proportional calculation and integral calculation, said upstream target air fuel ratio in accordance with an air fuel ratio deviation between the air fuel ratio detected by said downstream air fuel ratio sensor and a downstream target air fuel ratio so as to make the detected air fuel ratio of said downstream air fuel ratio sensor and said downstream target air fuel ratio coincide with each other;

wherein said second air fuel ratio feedback control section sets an integral gain of said integral calculation to be larger or an update period of said integral calculation to be smaller in accordance with an increasing flow rate of said exhaust gas, so that a change rate of said integral calculation with respect to said air fuel ratio deviation is increased; and said second air fuel ratio feedback control section also sets a proportional gain of said proportional calculation so as not to be changed with respect to a change in the flow rate of said exhaust gas.

2. An air fuel ratio control apparatus for an internal combustion engine characterized by comprising:

a catalyst that is arranged in an exhaust system of an internal combustion engine for purifying an exhaust gas from said internal combustion engine;

an upstream air fuel ratio sensor that is arranged at a location upstream of said catalyst for detecting an air fuel ratio in an upstream exhaust gas upstream of said catalyst;

a downstream air fuel ratio sensor that is arranged at a location downstream of said catalyst for detecting an air fuel ratio in a downstream exhaust gas downstream of said catalyst;

a first air fuel ratio feedback control section that makes the air fuel ratio in said upstream exhaust gas oscillate in a rich direction and in a lean direction in a periodic manner, and adjusts an amount of fuel supplied to said internal combustion engine in accordance with the air fuel ratio detected by said upstream air fuel ratio sensor and an upstream target average air fuel ratio so as to make an average value of said air fuel ratio thus oscillated and said upstream target average air fuel ratio coincide with each other; and a second air fuel ratio feedback control section that operates, by using at least proportional calculation and integral calculation, said upstream target average air fuel ratio in accordance with an air fuel ratio deviation between the air fuel ratio detected by said downstream air fuel ratio sensor and a downstream target air fuel ratio so as to make the detected air fuel ratio of said downstream air fuel ratio sensor and said downstream target air fuel ratio coincide with each other;

wherein that said second air fuel ratio feedback control section sets an integral gain of said integral calculation to be larger or an update period of said integral calculation to be smaller in accordance with an increasing flow rate of said exhaust gas, so that a change rate of said integral calculation with respect to said air fuel ratio deviation is increased; and said second air fuel ratio feedback control section also sets a proportional gain of said proportional calculation so as not to be changed with respect to a change in the flow rate of said exhaust gas.

3. The air fuel ratio control apparatus for an internal combustion engine as set forth in claim 2, characterized in that said first air fuel ratio feedback control section sets control constants of said first air fuel ratio feedback control section in accordance with said upstream target average air fuel ratio.

4. The air fuel ratio control apparatus for an internal combustion engine as set forth in claim 3, characterized in that said control constants set in accordance with said upstream target average air fuel ratio include values for any two or more parameters among delay times, skip amounts, integral gains, and a comparison voltage.

* * * * *